US011493880B2

(12) United States Patent
Nojima

(10) Patent No.: US 11,493,880 B2
(45) Date of Patent: Nov. 8, 2022

(54) IMAGE FORMING APPARATUS WITH REMOVAL OF DUST RESULTING FROM A PARTING AGENT CONTAINED IN TONER

(71) Applicant: CANON KABUSHIKI KAISHA, Tokyo (JP)

(72) Inventor: Koji Nojima, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/403,588

(22) Filed: Aug. 16, 2021

(65) Prior Publication Data

US 2021/0382436 A1 Dec. 9, 2021

Related U.S. Application Data

(63) Continuation of application No. PCT/JP2020/007884, filed on Feb. 19, 2020.

(30) Foreign Application Priority Data

Feb. 20, 2019 (JP) ..... JP2019-028862

(51) Int. Cl.
*G03G 21/00* (2006.01)
*G03G 21/20* (2006.01)
*G03G 15/20* (2006.01)

(52) U.S. Cl.
CPC ..... *G03G 21/206* (2013.01); *G03G 15/2017* (2013.01); *G03G 2221/1645* (2013.01)

(58) Field of Classification Search
CPC ..... G03G 21/206; G03G 2221/1645
USPC ..... 399/92, 93
See application file for complete search history.

(56) References Cited

U.S. PATENT DOCUMENTS

| | | | | |
|---|---|---|---|---|
| 6,915,096 | B2 | 7/2005 | Taka et al. | 399/301 |
| 9,207,636 | B1 | 12/2015 | Hamada | G03G 21/203 |
| 2003/0219274 | A1* | 11/2003 | Hirose | G03G 21/206 399/92 |
| 2004/0057756 | A1 | 3/2004 | Taka et al. | 399/301 |
| 2013/0183061 | A1 | 7/2013 | Park et al. | 399/98 |
| 2014/0161481 | A1* | 6/2014 | Udagawa | G03G 21/206 399/92 |

(Continued)

FOREIGN PATENT DOCUMENTS

| | | |
|---|---|---|
| JP | 2004-117738 | 4/2004 |
| JP | 2015-219432 | 12/2015 |

(Continued)

OTHER PUBLICATIONS

International Search Report and Written Opinion in counterpart International Application No. PCT/JP2020/007884, with English translations.

*Primary Examiner* — Robert B Beatty
(74) *Attorney, Agent, or Firm* — Venable LLP

(57) ABSTRACT

A control portion of an image forming apparatus causes an operation of a first fan start and then causes a second fan to start. The time when the operation of the second fan starts is from a predetermined time before the time when the leading end of one sheet reaches a fixing nip to the time when the rear end of the one sheet passes through the fixing nip. In this way, since the second fan operates after the first fan operates, fine particle dust is hardly discharged to the outside of the image forming apparatus, and it is possible to suppress dew condensation inside the image forming apparatus.

16 Claims, 23 Drawing Sheets

(56) References Cited

U.S. PATENT DOCUMENTS

| | | | | |
|---|---|---|---|---|
| 2015/0338799 | A1 | 11/2015 | Hamada | 399/92 |
| 2018/0292782 | A1* | 10/2018 | Nojima | G03G 15/2017 |
| 2021/0055678 | A1* | 2/2021 | Nojima | G03G 15/20 |

FOREIGN PATENT DOCUMENTS

| | | |
|---|---|---|
| JP | 2017-120284 | 7/2017 |
| JP | 2018-060106 | 4/2018 |

* cited by examiner (a)

(b)

IMAGE FORMING APPARATUS WITH REMOVAL OF DUST RESULTING FROM A PARTING AGENT CONTAINED IN TONER

This application is a continuation of International Application No. PCT/JP2020/007884 filed Feb. 19, 2020, currently pending; and claims priority under 35 U.S.C. § 119 to Japan Application JP 2019-028862 filed in Japan on Feb. 20, 2019; and the contents of all of which are incorporated herein by reference as if set forth in full.

TECHNICAL FIELD

The present invention concerns an image forming apparatus using electrophotographic technology, such as a printer, copier, FAX or multifunction device.

BACKGROUND ART

The image forming apparatus has a fixing device in the main assembly of the apparatus that fixes the toner image on the recording medium by applying heat and pressure to the recording medium on which the unfixed toner image is formed. The fixing device has a fixing belt and a pressure roller for applying pressure in contact with the fixing belt, and a fixing nip portion formed between the fixing belt and the pressure roller. The toner image is fixed to the recording medium by being nipped and fed while the recording medium is pressurized and heated.

By the way, since a large amount of toner adhering to the fixing belt can cause image defects, a toner containing wax (parting agent) is used to avoid this. In this case, when the toner is heated, the wax melts and covers the surface of the fixing belt, and the parting effect of the wax makes it difficult for the toner to adhere to the fixing belt afterwards. However, the wax adhered to the fixing belt starts to vaporize (gasify) when the surface temperature of the fixing belt becomes higher than a certain temperature. When the vaporized wax is cooled by the surrounding air, it forms particulate dust ranging from several nm to several hundred nm, which floats in the main assembly of the apparatus. This particulate dust is sticky, and when the ambient temperature becomes higher, some of them may gather together to form larger clumps of dust, which may adhere to various places in the main assembly of the apparatus. In the past, an image forming apparatus equipped with a filtration mechanism to collect these dusts has been proposed (Patent Document 1). The filtration mechanism has a suction fan for sucking the air inside the main assembly of the apparatus and a filter for filtering the dust contained in the sucked air.

In addition, the image forming apparatus has an exhaust mechanism that has an exhaust fan that exhausts air from the main assembly of the apparatus to the outside. In other words, since the recording medium is heated during the fixing of the toner image by the fixing device, the moisture contained in the recording medium may be vaporized in some cases. When the vaporized moisture is cooled, condensation occurs in the main assembly of the apparatus. In order to prevent such condensation, an exhaust mechanism is used to exhaust air from the main assembly of the apparatus to the outside.

SUMMARY OF THE INVENTION

Problem to be Solved by the Invention

However, the method of the image forming apparatus described in Japanese Laid-Open Patent Application No. 2017-120284 has room for improvement in terms of properly removing both dust and water vapor. The present invention was developed in consideration of the above-mentioned issue, and aims to provide an image forming apparatus that can properly remove both dust and water vapor.

Means for Solving the Problem

According to an aspect of the present invention, there is provided an image forming apparatus comprising: an image forming portion for forming a toner image on a recording material by using toner containing a parting agent; a transfer portion for transfer the toner image formed by said image forming portion to a sheet at a transfer nip portion; a fixing portion for heat fixing the toner image transferred by said transfer portion on the sheet at a fixing nip portion; a duct provided with a suction opening opposite to a sheet feeding passage between said transfer nip portion and said fixing nip portion; a filter provided on said duct; a first fan for discharging an air taken into said duct from said suction opening to an outside; a second fan for discharging an air in a neighborhood of a sheet exit of said fixing portion; a control portion for controlling operations of said first fan and said second fan, wherein said control portion is capable of performing operations such that in a case in which a signal for forming the image on the sheet is inputted, an operation of said first fan is started in accordance with a heating operation of said fixing portion, and an operation of said second fan is started until a first sheet passes through said fixing nip portion after the operation of said first fan is started.

Effect of the Invention

According to the present invention, both dust and water vapor can be properly removed.

BRIEF DESCRIPTION OF THE DRAWINGS

In FIG. 14, part (a) is an exploded view of the exhaust mechanism, part (b) is a view of the filter unit, and part (c) is a view of a position of a recording medium passing through.

EMBODIMENTS FOR CARRYING OUT THE INVENTION

The First Embodiment

<Image Forming Apparatus>

Figure 1:
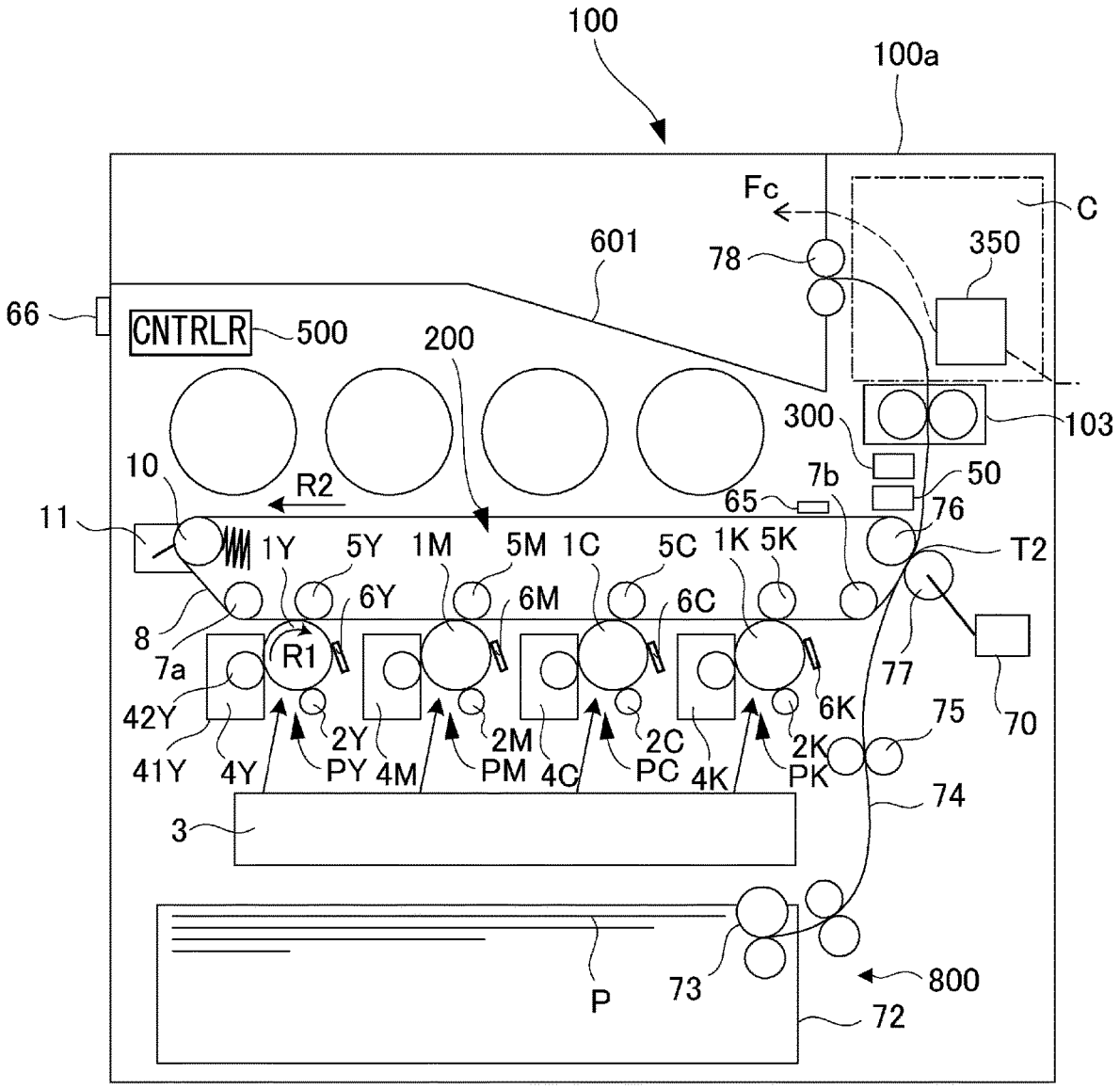
FIG. 1 is a schematic view of an image forming apparatus of a present embodiment.

The following is an explanation of the present embodiment. First, the image forming apparatus of the present embodiment is explained using FIG. 1. An image forming apparatus 100, which is a color image forming apparatus of the intermediate transfer tandem method, shown in FIG. 1 is an intermediate transfer tandem system in which image forming portions PY, PM, PC, PK of four colors (yellow, cyan, magenta, black) are arranged facing an intermediate transferring belt 8 in a main assembly of the apparatus 100*a*. A recording medium P that can be used in the image forming apparatus 100 includes various types of sheet materials, such as plain paper, thick paper, rough paper, uneven paper, coated paper, etc., OHP sheet, plastic film, cloth, etc. The image forming apparatus is controlled by a control portion 500, which will be described later. In the case of the present embodiment, the image forming portions PY~PK, primary transferring rollers 5Y~5K, an intermediate transferring belt 8, a secondary transfer inner roller 76, and a secondary transfer outer roller 77 constitutes an image forming unit 200 to form a toner image to the recording medium P. In addition, a cassette 72, a sheet feeding roller 73, a feeding path 74, and a resist roller 75 constitute a sheet feeding portion 800.

A process of feeding the recording medium in the image forming apparatus 100 is described below. The recording medium P is stored in the cassette 72 in the form of a stack, and is fed one sheet at a time by the sheet feeding roller 73 to the feeding path 74 in accordance with the image forming timing. The recording medium P stacked in the manual feed tray or stacking device (not shown) may also be fed one sheet at a time into the feeding path 74. When the recording medium P is fed to the resist roller 75 located in the middle of the feeding path 74, the resist roller 75 corrects the skew and timing of the recording medium P, and then it is fed to the secondary transfer portion T2. The secondary transfer portion T2 is a transfer nip portion formed by the opposing secondary transfer inner roller 76 and secondary transfer outer roller 77. The secondary transfer inner roller 76 as the transferring roller presses the intermediate transferring belt 8 from the inside to form the transfer portion of the toner image against the recording medium P. In the secondary transfer portion T2, the secondary transfer voltage is applied to the secondary transfer outer roller 77 by the power supply 70, and the toner image is transferred from the intermediate transferring belt 8 to the recording medium P by the current flowing between the secondary transfer outer roller 77 and the secondary transfer inner roller 76.

In contrast to the above process of feeding the recording medium P to the secondary transfer portion T2, the process of forming an image that is fed to the secondary transfer portion T2 at the same timing is explained below. First, image forming portions PY to PK are described. However, the image forming portions PY to PK are configured almost identically, except that the toner colors used in developing devices 4Y, 4M, 4C, and 4K are different: yellow, magenta, cyan, and black. Therefore, in the following, the yellow image forming portion PY will be explained as an example, and the other image forming portions PM, PC, and PK will be omitted. For convenience of the figures, only the image forming portion PY is marked for a developing container 41Y and a developing roller 42Y described below.

The image forming portion PY mainly consists of a photosensitive drum 1Y, a charging device 2Y, a developing device 4Y, and a photosensitive drum cleaner 6Y. The surface of the photosensitive drum 1Y, which is driven by rotation, is uniformly charged in advance by the charger 2Y, and then an electrostatic latent image is formed by the exposure device 3, which is driven based on the image information signal. Next, the electrostatic latent image formed on the photosensitive drum 1Y is converted into a visible image through toner development by the developing unit 4Y. The developing device 4Y has a developing container 41Y containing the developer, a developing roller 42Y (also called a developing sleeve) that rotates carrying the developer, and by applying a developing voltage to the developing roller 42Y, the electrostatic latent image is developed into a toner image. After that, the image forming portion PY and the primary transferring roller 5Y, which is placed opposite to the intermediate transferring belt 8, apply a predetermined pressure and primary transfer voltage, and the toner image formed on the photosensitive drum 1Y is primarily transferred to the intermediate transferring belt 8. The toner image formed on the photosensitive drum 1Y is transferred onto the intermediate transferring belt 8. A small amount of residual toner remaining on the photosensitive drum 1Y after primary transfer is removed by the photosensitive drum cleaner 6Y to prepare for the next imaging process.

The intermediate transferring belt 8 is stretched by a tension roller 10, the secondary transfer inner roller 76, and idler rollers 7*a* and 7*b* as tensioning rollers, and is driven to move in a direction of a arrow R2 in the figure. In the case of the present embodiment, the secondary transfer inner roller 76 also serves as the drive roller that drives the intermediate transferring belt 8. The image forming process for each color processed by the image forming portions PY to PK described above is performed at a timing to sequentially superimpose on the toner image of the color upstream in the moving direction that has been primary transferred on the intermediate transferring belt 8. As a result, a full-color toner image is finally formed on the intermediate transferring belt 8, and is transferred to the secondary transfer portion T2. The toner remaining after the transfer passes through the secondary transfer portion T2 is removed from the intermediate transferring belt 8 by the transfer cleaner device 11.

With the feeding process and the imaging process described above, the timing of the recording medium P and the full-color toner image matches in the secondary transfer portion T2, and the toner image is transferred from the intermediate transferring belt 8 to the recording medium P. After that, the recording medium P is fed to a fixing device 103, and the toner image is melted and adhered to the recording medium P by being pressurized and heated by the fixing device 103. Thus, the recording medium P on which the toner image has been fixed is discharged onto a discharge tray 601 by the discharging roller 78.

As shown in FIG. 1, the image forming apparatus 100 of the present embodiment has a filter unit 50, a cooling mechanism 300, and an air discharge mechanism 350. The filter unit 50, the cooling mechanism 300, and the air discharge mechanism 350 will be described later (see FIG. 13 to part (b) of FIG. 15). In addition, the image forming apparatus 100 of the present embodiment has an inside temperature sensor 65 for detecting the temperature inside the main assembly of the apparatus 100*a* (inside the main assembly of the apparatus), and an outside temperature sensor 66 for detecting the temperature outside the main assembly of the apparatus 100*a*. In this document, when simply referring to upstream or downstream without special mention, it refers to upstream or downstream with respect to a feeding direction of the recording medium P in the fixing device 103.

<Fixing Device>

Next, the fixing device 103 of the present embodiment will be explained using part (a) of FIG. 2 through FIG. 4. The fixing device 103 of the present embodiment is a low-heat-capacity fixing device that can fix toner images on the recording medium P by using an endless fixing belt 105 (hereinafter referred to simply as "belt") formed into a cylinder. The belt 105 can be a roller-shaped fixing roller.

Figure 2:
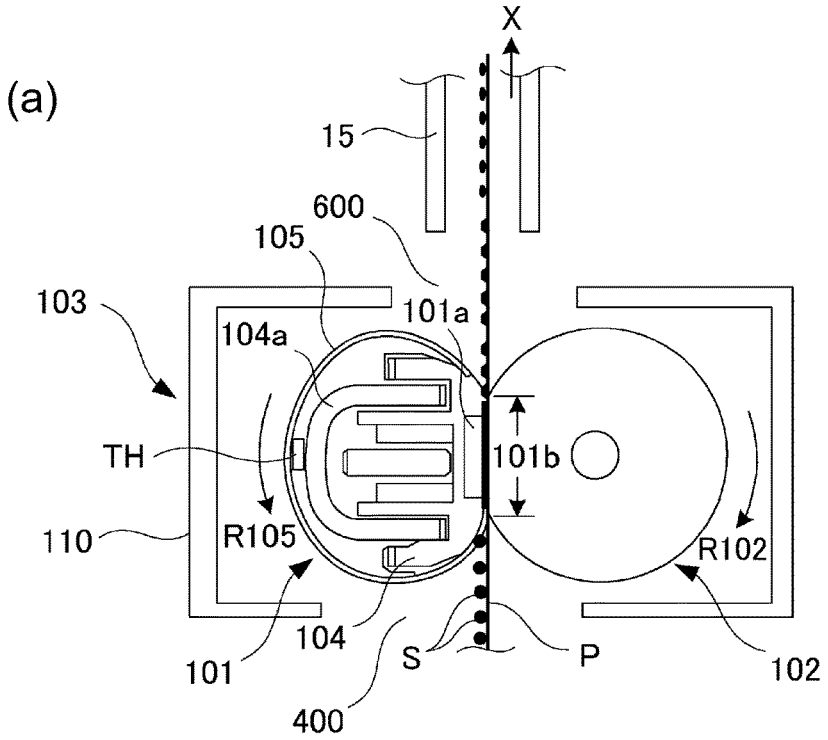
In FIG. 2, part (a) is a cross-sectional view showing a fixing device, and part (b) is an exploded view showing a belt unit.
Figure 2:
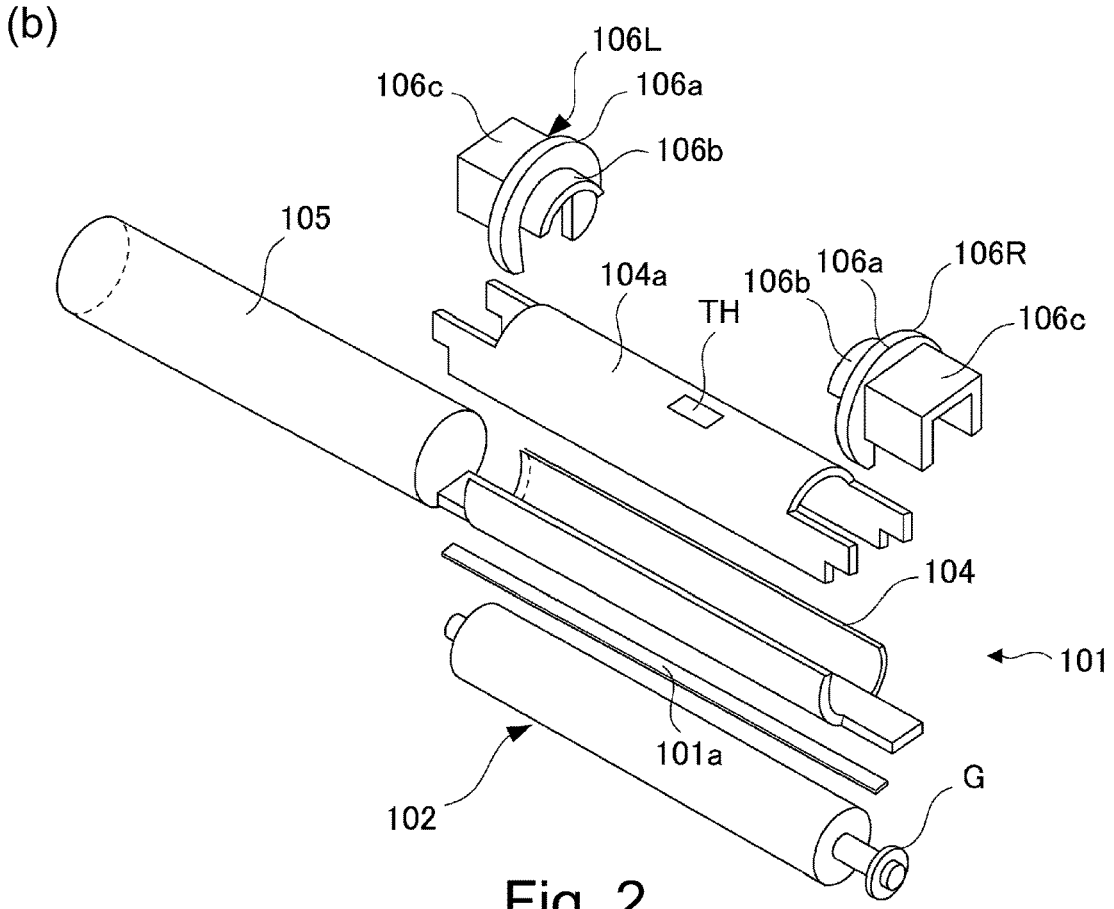

As shown in part (a) of FIG. 2, the fixing device 103 is equipped with a belt unit 101, a pressure roller 102 as a pressure-rotating member, a plate-shaped heater 101*a* as a heating member, and a casing 110. The casing 110 is provided with an open sheet entrance 400 and an open sheet exit 600. The sheet entrance 400 and sheet exit 600 allow the recording medium P to pass through the fixing nip portion 101*b* formed between the belt unit 101 and the pressure roller 102 in cooperation with them. In the present embodiment, the sheet entrance 400 is located lower in the gravitational direction than the sheet exit 600, so the recording medium P is fed from lower to upper in the gravitational direction (so-called vertical path feeding). On the downstream side of the sheet exit 600, there is a guide 15 that guides the feeding of the recording medium P that has passed through the fixing nip portion 101*b*.

The belt unit 101 is a unit that contacts the pressure roller 102 to form a fixing nip portion 101*b* between the belt 105 and the pressure roller 102, and fixes the toner image to the recording medium P in the fixing nip portion 101*b*. The belt unit 101 is an assembly consisting of multiple members as shown in parts (a) and (b) of FIG. 2. The belt unit 101 has a surface-shaped heater 101*a*, a heater holder 104 that holds the heater 101*a*, and a pressure stay 104*a* that supports the heater holder 104. The belt unit 101 also has the endless belt 105 and flanges 106L and 106R that hold one end side and the other end side of the belt 105 in the width direction (rotational axis direction), respectively.

The heater 101*a* is a heating member that contacts the inner surface of the belt 105 and heats the belt 105. In the present embodiment, a ceramic heater that generates heat when energized is used as the heater 101*a*. The ceramic heater, which is not shown in the figure, is a low-heat-capacity heater that is equipped with a long, thin ceramic substrate and a resistance layer on the substrate surface, and the entire heater heats up quickly when the resistance layer is energized. The heater holder 104, which holds the heater 101*a*, has a semi-circular arc shape in the cross-sectional area and regulates the shape of the belt 105 in the circumferential direction. It is desirable to use a heat-resistant resin as the material of the heater holder 104.

The pressure stay 104*a* is a member that presses the heater 101*a* and heater holder 104 uniformly against the belt 105 in the longitudinal direction. The pressure stay 104*a* should be made of a material that does not flex easily even when high pressure is applied. In the present embodiment, stainless steel SUS304 is used as the material for the pressure stay 104*a*. A thermistor TH is installed on the pressure stay 104*a*. The thermistor TH outputs a signal to the control portion 500 according to the temperature of the belt 105.

The belt 105 is a rotating member that contacts the recording medium P and applies heat to the recording medium P. The belt 105 is a cylindrical (cylinder-shaped) belt (film) and has overall flexibility. The belt 105 is provided to cover the heater 101*a*, the heater holder 104, and the pressure stay 104*a* from the outside.

The flanges 106L and 106R are a pair of members that hold the widthwise end of the belt 105 in a rotatable manner. The flanges 106L and 106R have a flange portion 106*a*, a backup portion 106*b*, and a pressurized portion 106*c*, respectively, as shown in part (b) of FIG. 2. The flange portion 106*a* is a portion that receives the end surface of the belt 105 and regulates the movement of the belt 105 in the direction of the rotational axis, and is formed in an outline larger than the diameter of the belt 105. The backup portion 106*b* is a portion that holds the inner surface of the end of the belt 105 to maintain the cylindrical shape of the belt 105. The pressurized portion 106*c* is provided on the outer surface of the flange portion 106*a* and receives the pressing pressure from the pressure springs 108L and 108R (see FIG. 4) described below.

Next, the constitution of the belt 105 as the first rotating member, the pressure roller 102 as the second rotating member, and the fixing nip portion 101*b* will be explained using parts (a) of FIG. 3 and FIG. 4. The belt 105 is composed of multiple layers. As shown in part (b) of FIG. 3, the belt 105 has a base layer 105*a*, a primer layer 105*b*, an elastic layer 105*c*, and a parting layer 105*d*, in order from the inside to the outside. The base layer 105*a* is a layer to ensure the strength of the belt 105. The base layer 105*a* is a base layer made of metal such as SUS (stainless steel) and is formed to a thickness of, for example, 30 μm to withstand thermal and mechanical stress. The primer layer 105*b* is a layer for bonding the base layer 105*a* and the elastic layer 105*c*. The primer layer is formed by applying a primer to the base layer 105*a* at a thickness of about 5 μm. The elastic layer 105*c* is deformed when the fixing nip portion 101*b* presses against the toner image, and serves to adhere the parting layer 105*d* to the toner image. Heat-resistant rubber can be used as the elastic layer 105*c*. The parting layer 105*d* is a layer that prevents toner and paper dust from adhering to the belt 105. Fluorinated resin such as PFA, which has excellent parting and heat resistance, can be used as the parting layer 105*d*. The parting layer 105*d* is formed to a thickness of 20 μm, for example, in consideration of heat transfer properties.

Figure 3:
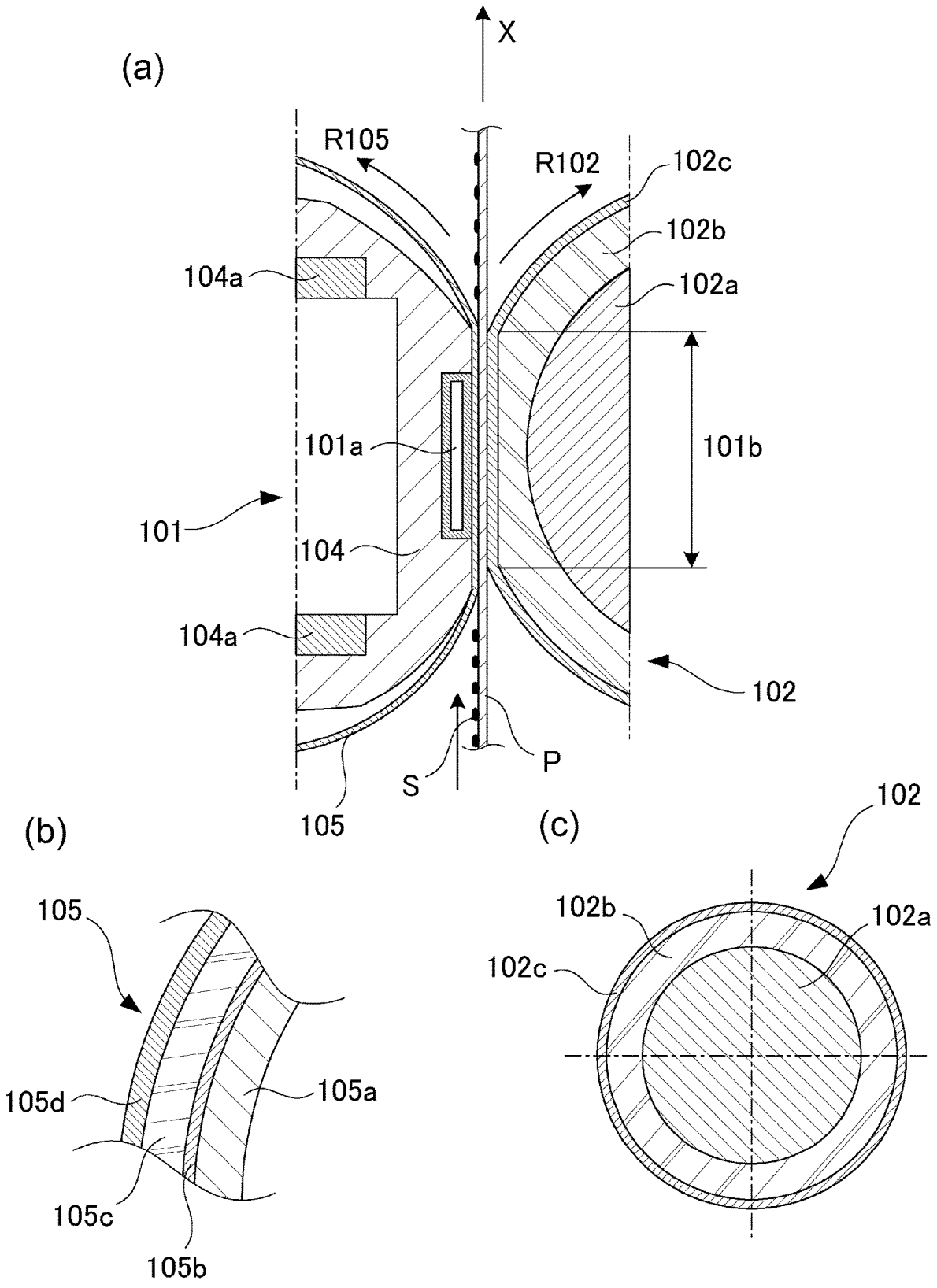
In FIG. 3, part (a) is a cross-sectional view showing the area near a fixing nip portion, part (b) is a partial cross-sectional view showing a layer structure of a fixing belt, and part (c) is a cross-sectional view showing a layer structure of a pressure roller.

As shown in part (a) of FIG. 3, the pressure roller 102 is a nip-forming member that contacts the outer peripheral surface of the belt to form a fixing nip portion 101*b* with the belt. The pressure roller 102 is a roller member composed of multiple layers. As shown in part (c) of FIG. 3, the pressure roller 102 has a metal (aluminum or iron) core 102*a*, an elastic layer 102*b* made of silicon rubber or the like, and a parting layer 102*c* that covers the elastic layer 102*b*. The parting layer 102*c* is a tube made of fluorine resin such as PFA and is adhered to the elastic layer 102*b*. The pressure roller 102 can be a belt-like pressure belt.

Figure 4:
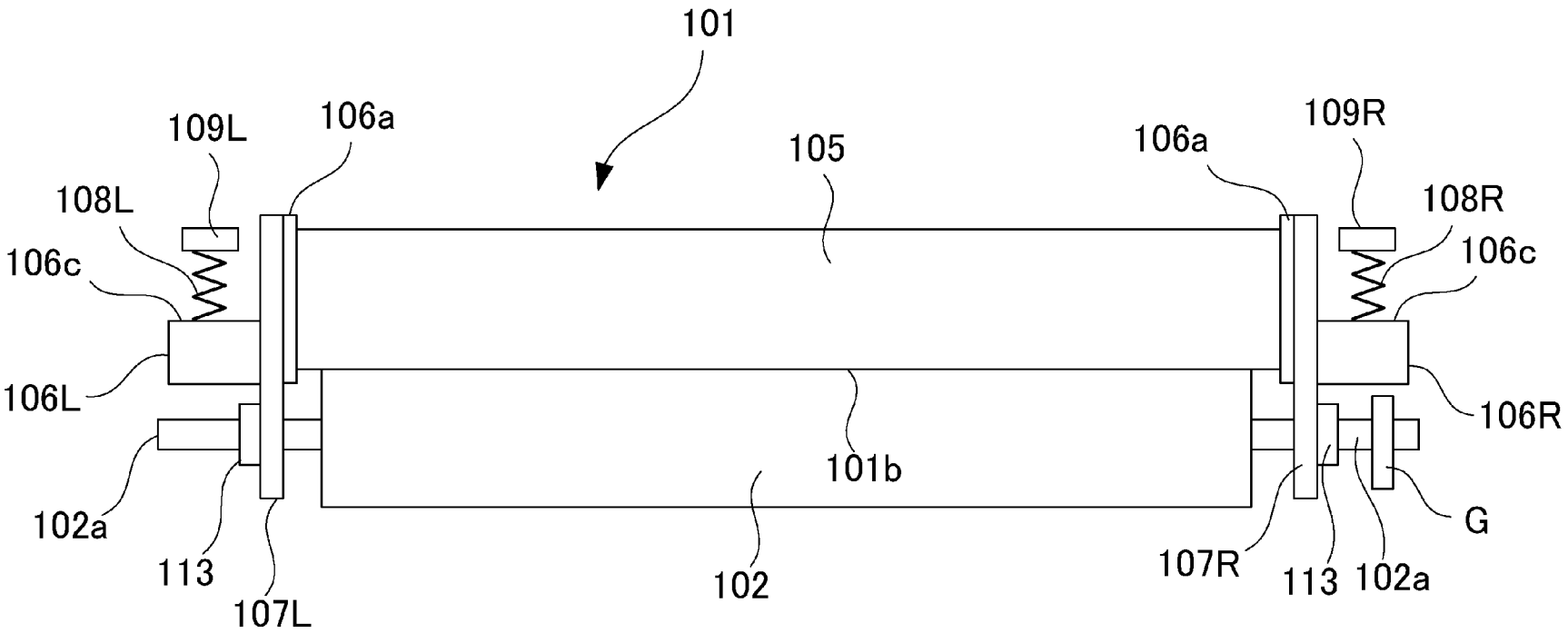
FIG. 4 is a schematic view explaining the pressurization between a fixing roller and the pressure roller.

As shown in FIG. 4, one end of the core metal 102*a* is supported in a rotatable manner on the side plate 107L at one end of the casing 110 via a bearing 113. The other end side of the core metal 102*a* is supported in a rotatable manner by the side plate 107R on the other end side of the casing 110 via the bearing 113. The portion of the pressure roller 102 having the elastic layer 102*b* and the parting layer 102*c* is located between the side plate 107L and the side plate 107R. The other end side of the core metal 102*a* is connected to the gear G. When the gear G receives drive from the drive motor (not shown), the pressure roller 102 is driven in the direction of the arrow R102 (see part (a) of FIG. 3).

The belt unit 101 is supported by the side plates 107L and 107R so that it can slide in the direction of proximity to and separation from the pressure roller 102. In detail, the flanges 106L and 106R are provided so that they fit into the guide grooves (not shown) of the side plates 107L and 107R. The pressurized portions 106*c* of the flanges 106L and 106R are pressed with a predetermined pressing force in the direction toward the pressure roller 102 by the pressure springs 108L and 108R supported by the spring support portions 109L and 109R.

The above pressing force pushes the entire flanges 106L, 106R, pressure stay 104*a*, and heater holder 104 in the direction of the pressure roller 102. Here, the side of the belt unit 101 with the heater 101*a* faces the pressure roller 102. Therefore, the heater 101*a* presses the belt 105 toward the pressure roller 102. This constitution deforms the belt 105 and the pressure roller 102, and a fixing nip portion 101*b* (see part (a) of FIG. 3) is formed between the belt 105 and the pressure roller 102.

When the pressure roller 102 rotates while the belt unit 101 and the pressure roller 102 are in close contact, the frictional force between the belt 105 and the pressure roller 102 at the fixing nip portion 101*b* exerts a rotational torque on the belt 105. The belt 105 rotates according to the pressure roller 102. The rotational speed of the belt at this time roughly corresponds to the rotational speed of the pressure roller 102. In other words, in the case of the present embodiment, the pressure roller 102 functions as a drive roller that rotates and drives the belt 105. Since the inner peripheral surface of the belt 105 and the heater 101*a* slide with each other, it is desirable to apply grease to the inner surface of the belt 105 to reduce the sliding resistance.

<Control Portion>

Figure 5:
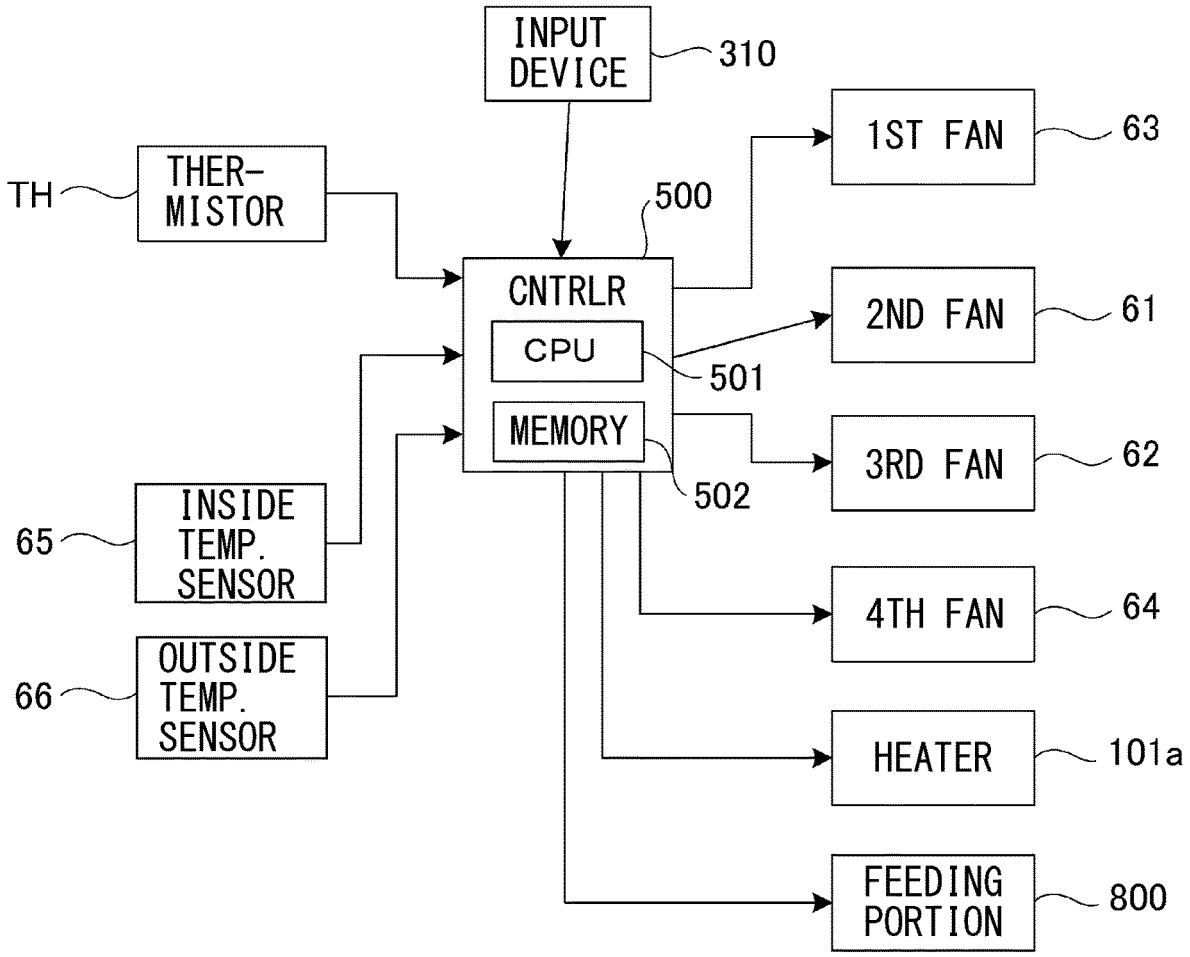
FIG. 5 is a control block diagram to explain a control portion.

As shown in FIG. 1, the image forming apparatus 100 is equipped with a control portion 500, which is described in FIG. 5. The control portion 500 is connected to various devices such as a motor, power supply, and the above-mentioned image forming portions PY to PK to operate the image forming apparatus 100 in addition to those shown in the figure. However, since they are not the main purpose of the present invention, their illustration and explanation are omitted.

The control portion 500 as the control means performs various controls of the image forming apparatus 100 such as image forming operations, and has, for example, a CPU 501 (Central Processing Unit) and a memory 502. The memory 502 is composed of ROM (Read Only Memory), RAM (Random Access Memory), and the like. The CPU 501 is capable of executing various programs stored in the memory 502, and can operate the image forming apparatus 100 by executing the various programs. In the case of the present embodiment, the CPU 501 is capable of executing the "image forming job processing (program)" (not shown) and the "fan control processing (program)" (see FIG. 16 below) stored in the memory 502. The memory 502 can also temporarily store calculation processing results, etc. associated with the execution of various programs.

An image forming job is a series of operations from the start of image forming to the completion of image forming operation based on the print signal to form images in recording medium P. In other words, it is a series of operations from the start of the preliminary operation (so-called front rotation) necessary for image formation, through the image formation process, to the completion of the preliminary operation (so-called back rotation) necessary for finishing image formation. Specifically, it refers to the period from the front rotation after receiving the print signal (preparative operation before image formation) to the back rotation (operation after image formation), including the image formation period and the paper interval.

An input device 310 is connected to the control portion 500 via an input/output interface. The input device 310 is, for example, an operation panel, an external terminal such as a personal computer, etc., which enables the user to give instructions for starting various programs such as an image forming job, input of various data, etc. When an instruction to start an image forming job is given from the input device 310, the CPU 501 executes the "image forming job processing" stored in the memory 502. The CPU 501 controls the operation of the image forming apparatus 100 based on the execution of the "image forming job processing".

The control portion 500 is connected to the above thermistor TH, the inside temperature sensor 65, the outside temperature sensor 66, and the heater 101*a* via an input/output interface. The control portion 500 can adjust the temperature of the heater 101*a* based on the detection result of the thermistor TH. In addition, the sheet feeding portion 800, the first fan 63, the second fan 61, the third fan 62, and the fourth fan 64 (see part (a) of FIG. 14) described below are connected to the control portion 500 via an input/output interface. In the case of the present embodiment, the control portion 500 controls the sheet feeding portion 800, the first fan 63, the second fan 61, the third fan 62, and the fourth fan 64 based on the detection results of the inside temperature sensor 65 and the outside temperature sensor 66 by executing the "fan control processing" (see FIG. 16, FIG. 17, and FIG. 18) described below.

<Fixing Process>

Here, the control of the fixing device 103 (called the fixing process) and the fixing operation during an image forming job by the control portion 500 will be explained with reference to part (a) of FIG. 2. When the control portion 500 receives an instruction to start an image forming job from the input device 310, it causes the sheet feeding portion 800 to feed the recording medium P toward the secondary transfer portion T2 described above, and makes the recording medium P stand by with the tip of the recording medium P against the secondary transfer portion T2. On the other hand, the control portion 500 uses a drive motor (not shown) to rotate and drive the pressure roller 102 in the direction of rotation (arrow R102) at a predetermined speed, and the belt 105 is rotated accordingly. In addition, the control portion 500 starts to energize the heater 101*a* via the power supply circuit (not shown). The heater 101*a* generates heat by this energization, and heats the belt 105 rotating in the fixing nip portion 101*b* while sliding with its inner surface in close contact with the heater 101*a*. The heated belt 105 rises from the initial temperature Ts (see part (a) of FIG. 20 below) and gradually becomes hotter. Since the thermistor TH is located on the top of the pressure stay 104*a* and is in elastic contact with the inner surface of the rotating belt 105, the thermistor TH detects the temperature of the rotating belt 105 and transmits the detection result to the control portion 500. The control portion 500 controls the energization of the heater 101*a* based on the signal output by the thermistor TH so that the surface temperature Tb of the belt 105 becomes the target temperature Tp (see part (a) of FIG. 20). In the case of the present embodiment, the target temperature Tp is approximately 170° C.

When the belt 105 is heated to the target temperature Tp and the fixing device 103 is ready to fix, and the control portion 500 determines that the image forming portion PY~PK is ready to start image formation, the control portion 500 activates the image forming portion PY~PK. In addition, the control portion 500 activates the image forming portions PY~PK and feeds the recording medium P that was waiting in the secondary transfer portion T2 toward the fixing device 103. At this time, the control portion 500 emits a signal (referred to as ITOP in the present invention) that means the start of image formation, and the feeding of the recording medium P starts after the ITOP signal is generated. The time from when the signal ITOP is generated until the tip of the first recording medium reaches the fixing nip portion 101*b* is always constant (e.g., less than one second). This signal ITOP is used to control the operation of the fan as described below. The recording medium P to which the toner image has been transferred in the secondary transfer portion T2 is fed toward the fixing device 103 and is nipped and fed by the fixing nip portion 101*b*. In the process of being nipped and fed by the fixing nip portion 101*b*, the recording medium P is subjected to the heat of the heater 101*a* via the belt 105. The unfixed toner image on the recording medium P is melted by the heat of the heater 101*a* and is fixed to the recording medium P by the pressure applied to the fixing nip portion 101*b*. The recording medium P that has passed through the fixing nip portion 101*b* is guided by the guide 15 to the discharging roller 78 and is discharged onto the discharge tray 601 by the discharging roller 78 (see FIG. 1). In general, the control portion 500 of the image forming apparatus automatically determines whether or not the conditions necessary to form an optimal image are in place after receiving an image forming commencement job, and performs an image density adjustment operation as necessary. This operation is performed by forming a test image on the intermediate transferring belt 8, checking its density with a density sensor (not shown), and adjusting the setting values related to development. Another way is to detect the position of the recording medium P and automatically adjust the operation of the feeding mechanism. The adjustment operation takes more than ten seconds and may be performed after the belt 105 has been heated to the target temperature Tp. The adjustment operation in the present embodiment shall be an operation with an operation time of more than a predetermined time. In other words, when the adjustment operation is performed in the middle of continuous image formation, the interruption of the image formation operation is for a predetermined period of time, such as more than ten seconds. Even if the target temperature Tp is reached, it does not mean that the recording medium P always reaches the fixing nip portion 101*b* after a certain time. The time at which the recording medium P reaches the fixing nip portion 101*b* is determined by the time at which the adjustment operation is completed and the signal ITOP is generated. The adjustment operation may be started while continuous image formation is in progress. For example, after the control portion 500 receives an image formation commencement job to form 100 consecutive images and starts image formation, the control portion 500 may determine that an adjustment operation is required when 20 images have been formed. In this case, the control portion 500 temporarily stops (interrupts) the image formation. In addition, if the control portion 500 determines that the image forming portions PY to PK are ready to start image formation after the adjustment operation is completed, the control portion 500 issues the aforementioned image formation commencement signal ITOP to resume image formation. Thereafter, the control portion 500 continues image formation until it completes the image forming job of 100 sheets.

<Regarding Dust>

In the fixing device 103, the toner image is fixed to the recording medium P by bringing the high-temperature belt 105 into contact with the recording medium P. In this case, some toner S may adhere to the belt 105 when the recording medium P passes through the fixing nip portion 101*b* during the fixing process described above (called offset phenomenon, etc.). Toner S adhering to the belt 105 causes image defects. Therefore, the present embodiment uses a toner S containing wax (parting agent) made of paraffin, for example, to prevent the toner S from adhering to the belt 105. When the toner S is heated, the wax dissolves and seeps out from the surface. When the toner S is heated and the wax dissolves during the fixing process, the surface of the belt 105 is covered with the dissolved wax. When the surface is covered with wax, the parting effect of the wax makes it difficult for the toner S to adhere to the belt 105.

In the present embodiment, the term "wax" is used to include not only pure waxes but also compounds containing the molecular structure of waxes. For example, a compound in which the resin molecule of the toner reacts with a wax molecular structure such as a hydrocarbon chain. In addition to waxes, substances with a parting action such as silicon oil may be used as the parting agent.

However, a portion of the wax adhered to the belt 105 will vaporize (gasify) when the surface temperature of the belt 105 rises above the predetermined temperature. When the vaporized wax components are cooled in the air, they solidify to form ultra fine particles (UFPs) with a particle diameter of several to several hundred nm. This phenomenon is called nucleation and it occurs when the wax vaporized by heat is exposed to a lower temperature environment and is supercooled. The degree of undercooling can be expressed by the degree of undercooling ΔT, which is the difference between the dust generation temperature Tws (see part (b) of FIG. 7), which is the temperature at which dust begins to form when the volatiles are gradually heated, and the space temperature Ta in the surrounding space where nucleation is occurring (Formula 1):

$$\text{Supercooling temperature } \Delta T(^\circ\text{ C.}) = \text{dust generation temperature } Tws(^\circ\text{ C.}) - \text{space temperature } Ta(^\circ\text{ C.}) \quad \text{(Formula 1)}$$

The larger the supercooling temperature ΔT, the more rapidly the vaporized wax is cooled and the more likely it is to nucleate. This means that nucleation occurs at more locations in a given volume of space. In other words, the larger the supercooling temperature ΔT is, the more dust (UFP) is generated. As the supercooling temperature ΔT decreases, the number of nucleation sites decreases. As the supercooling temperature ΔT decreases, the number of nucleation sites decreases, and the fine dust particles are agglomerated into the nuclei, resulting in larger clumps of dust. In other words, when the supercooling temperature ΔT is large, a large number of small particle size dusts (UFPs) are generated, and when the supercooling temperature ΔT is small, a small number of large particle size dusts are generated.

Since dust is an adhesive wax, it tends to adhere to various places in the main assembly of the apparatus 100*a*. For example, if the dust is carried to the vicinity of the guide 15 and discharging roller 78 by the updraft caused by the heat of the fixing device 103, the dust will adhere to the guide 15 and discharging roller 78 and be stuck to them. In order to remove it, the frequency of cleaning intervals needs to be increased, which increases the maintenance workload.

<Properties of Dust>

Figure 6:
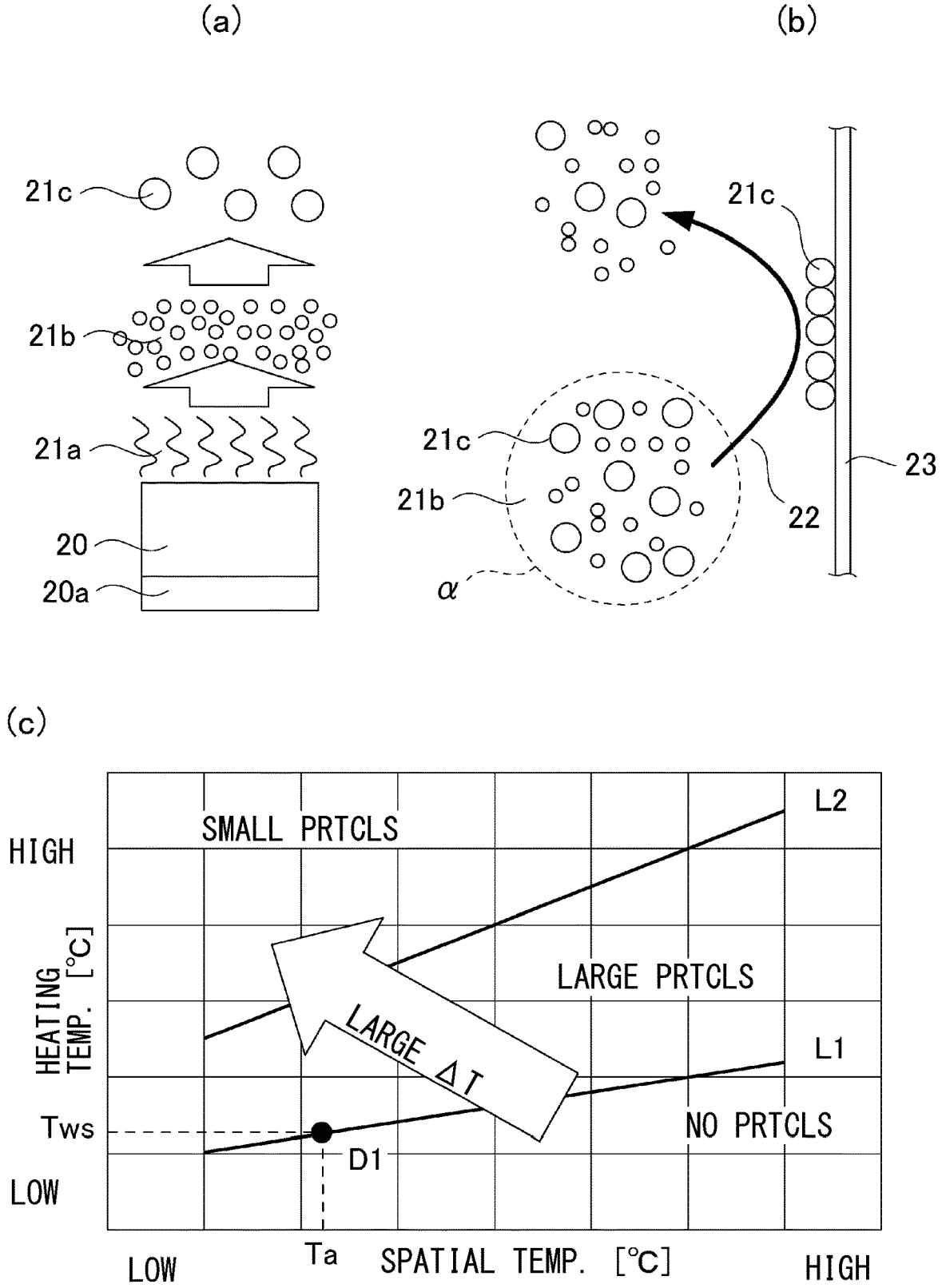
In FIG. 6, part (a) is a view explaining a dust formation process, part (b) is a view explaining a dust adhesion phenomenon, and part (c) is a graph explaining that the presence or absence of dust and a size of particles are determined by a relationship between a toner heating temperature and an ambient space temperature.

Parts (a) through (c) of FIG. 6 illustrate the properties of the dust described above. Part (a) of FIG. 6 shows the process of dust formation, part (b) of FIG. 6 shows the phenomenon of dust adhesion, and part (c) of FIG. 6 shows the relationship between the heating temperature of the toner and the temperature of the surrounding space, which determines the presence of dust and the size of the particles.

As shown in part (a) of FIG. 6, when a high-boiling-point material 20 with a boiling point between 150° C. and 200° C. is placed on a heating source 20*a* and heated to around 200° C., a volatile material 21*a* (gas) is generated from the high-boiling-point material 20. When the volatile material 21*a* comes into contact with the surrounding air, it is supercooled and condenses in the air, transforming into micro dust 21*b* (UFP) with a particle diameter of about several nm. Then, the volatile material 21*a* gathers around the micro dust 21*b* and agglomerates, and also the micro dust 21*b* collides with each other, causing the micro dust 21*b* to grow into a larger clump of dust 21*c*. As shown in part (c) of FIG. 6, the agglomeration/dusting of volatile material 21*a* in the air is inhibited as the heating temperature is lower and the space temperature is higher, i.e., in the direction of the lower right in the figure (the direction in which the supercooling temperature decreases). This means that when the heating temperature is low (supercooling temperature→small), the amount of volatile material 21*a*, which is the seed of dust formation, becomes less volatile, and when the space temperature is high (supercooling temperature→small), the saturated vapor pressure of volatile material 21*a* increases, and volatile material 21*a* (gas molecules) can easily maintain its gaseous state. In other words, the smaller the supercooling temperature ΔT is, the more the dust (UFP) formation is inhibited. The lines L1 and L2 in part (c) of FIG. 6 schematically represent the region where the dust formation phenomenon changes. When the heating temperature and the space temperature enter the region below the right side of the line L1 shown in part (c) of FIG. 6, dust (UFP) production becomes difficult.

On the contrary, dust formation in the air is accelerated when the heating temperature is higher and the space temperature is lower, i.e., when the supercooling temperature moves to the upper left of the line L1 in the figure (supercooling temperature→large). This is because the higher the heating temperature, the higher the volatilization of the gas that is the seed of dust formation, and the lower the space temperature, the lower the saturated vapor pressure of the volatiles 21*a*, which promotes the atomization of the volatiles 21*a* (gas molecules). In other words, the larger the supercooling temperature ΔT is, the more dust generation is promoted and the more dust is generated. Furthermore, as the supercooling temperature ΔT increases and enters the region to the upper left of the line L2, the size of the dust becomes smaller and the number of dust particles increases. This is because as the supercooling temperature ΔT increases, the number of nucleation sites also increases.

Next, in part (b) of FIG. 6, consider the case where air a containing micro dust 21*b* (UFP) and larger dust 21*c* follows the airflow 22 to the wall 23. At this time, the larger dust 21*c* adheres to the wall 23 more easily than the smaller dust 21*b*, and is difficult to diffuse, because the dust 21*c* has a large inertia force and collides with the wall 23 vigorously. Therefore, the higher the temperature of the environment and the larger the particle size of the dust, the more likely it is to adhere to the fixing device (mostly to the fixing belt), and consequently the less likely it is to diffuse outside the fixing device.

Thus, fine dust particles (UFPs) have two properties: they coalesce and become larger in size at high temperatures, and they adhere more easily to surrounding objects due to their larger size. The ease of coalescence of dust depends on the constitution, temperature, and concentration of the dust. For example, if the component that tends to adhere becomes soft due to high temperature, and if the probability of dust colliding with each other increases due to high concentration, it will be easier to coalesce.

<Dust Generation Temperature>

The dust generation temperature Tws, which is the temperature at which particulate dust (UFP) begins to be generated when volatile materials are gradually heated, is a physical property unique to toner that is used to calculate the supercooling temperature ΔT. The dust generation temperature Tws is explained using parts (a) and (b) of FIG. 7. Part (a) of FIG. 7 shows a schematic view of the experimental apparatus for measuring the dust generation temperature, and part (b) of FIG. 7 shows a graph showing the relationship between the heater temperature and the dust concentration.

The dust generation temperature Tws inherent to the toner is measured using a chamber with a content area of 0.5 $m^3$. As the measurement conditions, the chamber is set at a temperature of 23±2° C., humidity of 50±5%, and ventilation rate of 4 times/h. The heater 101*a* installed inside is started at room temperature (23±2° C.) and the temperature is raised at a rate of 3° C./minute. A toner containing wax is placed on the heater 101*a*. The dust generated by the vaporization of the wax contained in the toner is measured by a nanoparticle particle size analyzer, "FMPS Model 3091 (manufactured by TSI)", which is connected to the chamber.

From the relationship between the heater temperature and the dust concentration obtained as a result of the measurement of the nanoparticle particle size analyzer (see part (b) of FIG. 7), the mean value and standard deviation of the dust concentration in the area where no dust is generated (in this case, below 170° C.) are calculated. Then, the dust concentration variation of the measurement system is calculated as "mean value+3× standard deviation". The temperature at the time when the dust concentration exceeding the "mean value+3× standard deviation", which is the variation of the measurement system, is detected for the first time and is defined as the dust generation temperature. In this case, 179° C. was the dust generation temperature (° C.). The dust generation temperature depends on the temperature of the space inside the chamber, as shown in part (c) of FIG. 6 above. The lower the space temperature, the lower the heating temperature when the dust is generated. The dust generation temperature measured under the above conditions is represented by the point D1 on the line L1 in part (c) of FIG. 6.

Figure 7:
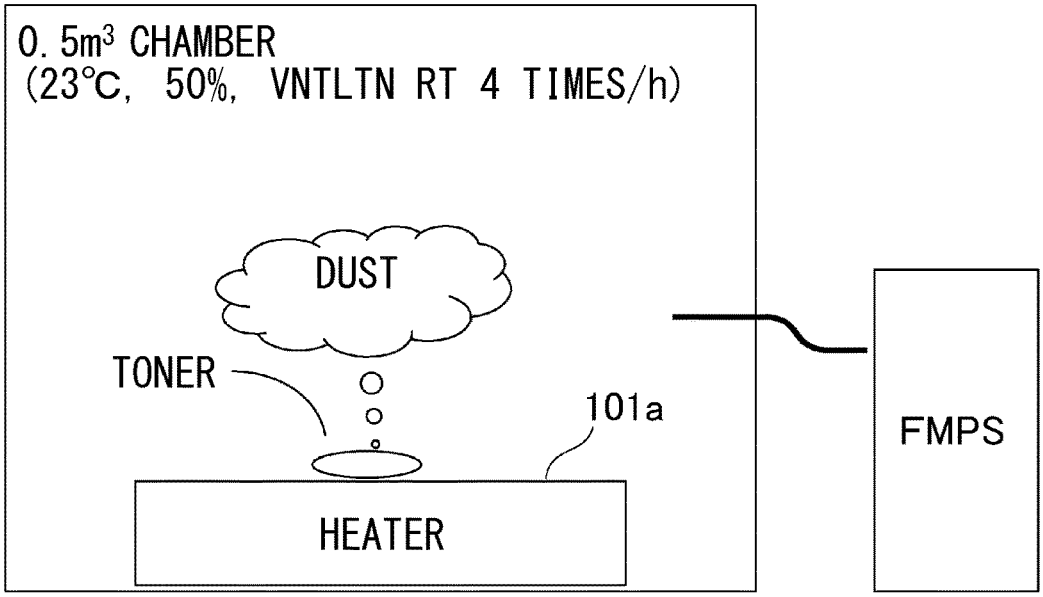
In FIG. 7, part (a) is a schematic view of the experimental apparatus used to measure the dust generation temperature, and part (b) is a graph showing a relationship between a heater temperature and a dust concentration.
Figure 7:
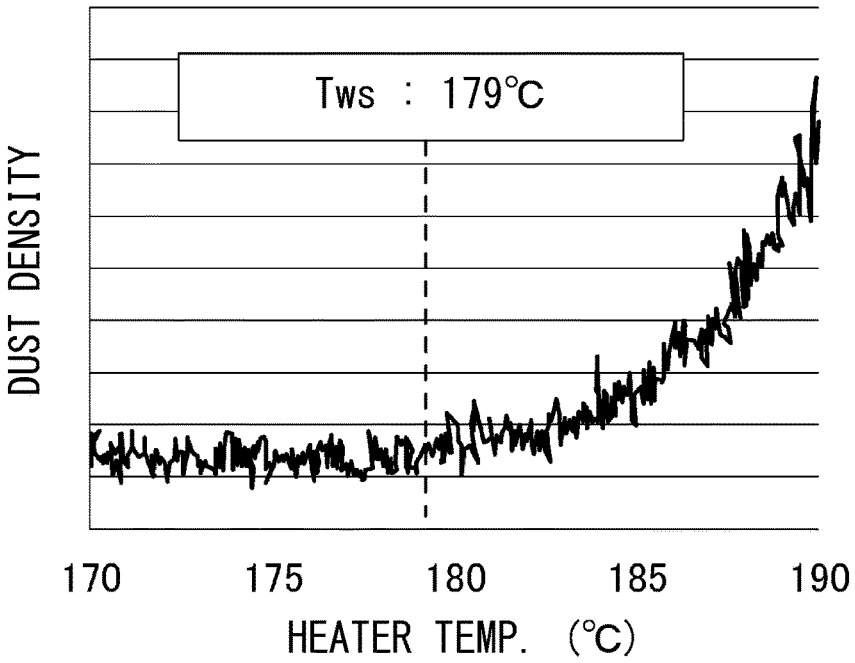

However, in the image forming apparatus 100, the actual dust generation temperature Tws is about 20° C. lower than the temperature measured using the dust generation temperature measurement device shown in part (a) of FIG. 7, for example. This is because in the image forming apparatus 100, dust is generated from the wax adhered to the belt 105, and the temperature in the space near the belt 105 where dust is generated in the image forming apparatus 100 tends to be lower than the temperature in the space above the heater 101*a*. In other words, the temperature of the space near the surface of the heated belt 105 tends to be lower than the temperature of the space away from the belt 105 because the airflow generated by the rotation of the belt 105 draws in cold air from the outside. On the other hand, in the device shown in part (a) of FIG. 7, the space temperature above the heater 101*a* is cooled by the airflow generated by thermal convection (which is weaker than the airflow generated by the rotation of the belt 105), so the temperature drops more slowly than that of the belt 105. As a result, the space temperature near the surface of the belt 105 is lower than the space temperature above the heater 101*a*, even if the image forming apparatus 100 is placed in an environment of 23° C., the same as the temperature inside the chamber.

As shown in part (c) of FIG. 6, the space temperature in the vicinity of the surface of the heated belt 105 becomes the temperature in the direction where the space temperature is lower than point D1 on line L1, that is, the temperature is shifted to the lower left on line L1. As a result, the temperature at which dust is generated is also lowered. According to the inventor's experiment, this temperature decrease is about 20° C. in the present embodiment. If the above temperature decrease range is set as the predetermined adjustment temperature value Z (° C.), the dust generation temperature Tws (° C.) of the image forming apparatus 100 can be expressed as a general formula in Formula (2):

Dust generation temperature *Tws*(° C.) of image forming apparatus=Dust generation temperature of experimental apparatus (° C.)−*Z*(° C.) (Formula 2)

<Dust Generation Points>

Figure 8:
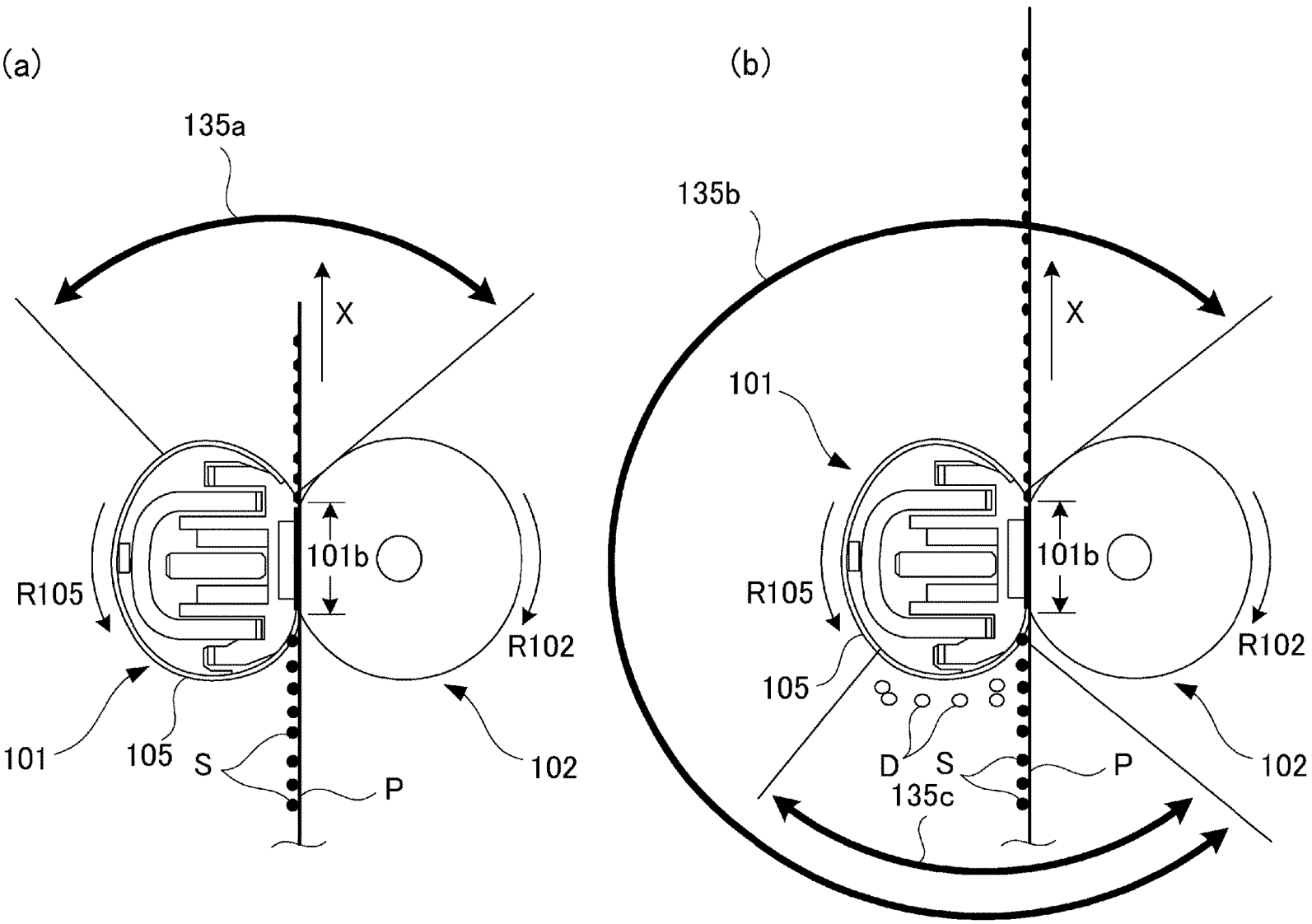
In FIG. 8, part (a) is a view of a wax adhesion area on the fixing belt, which expands as a fixing process progresses, and part (b) is a view of a relationship between the wax adhesion area and a dust generation area.
Figure 9:
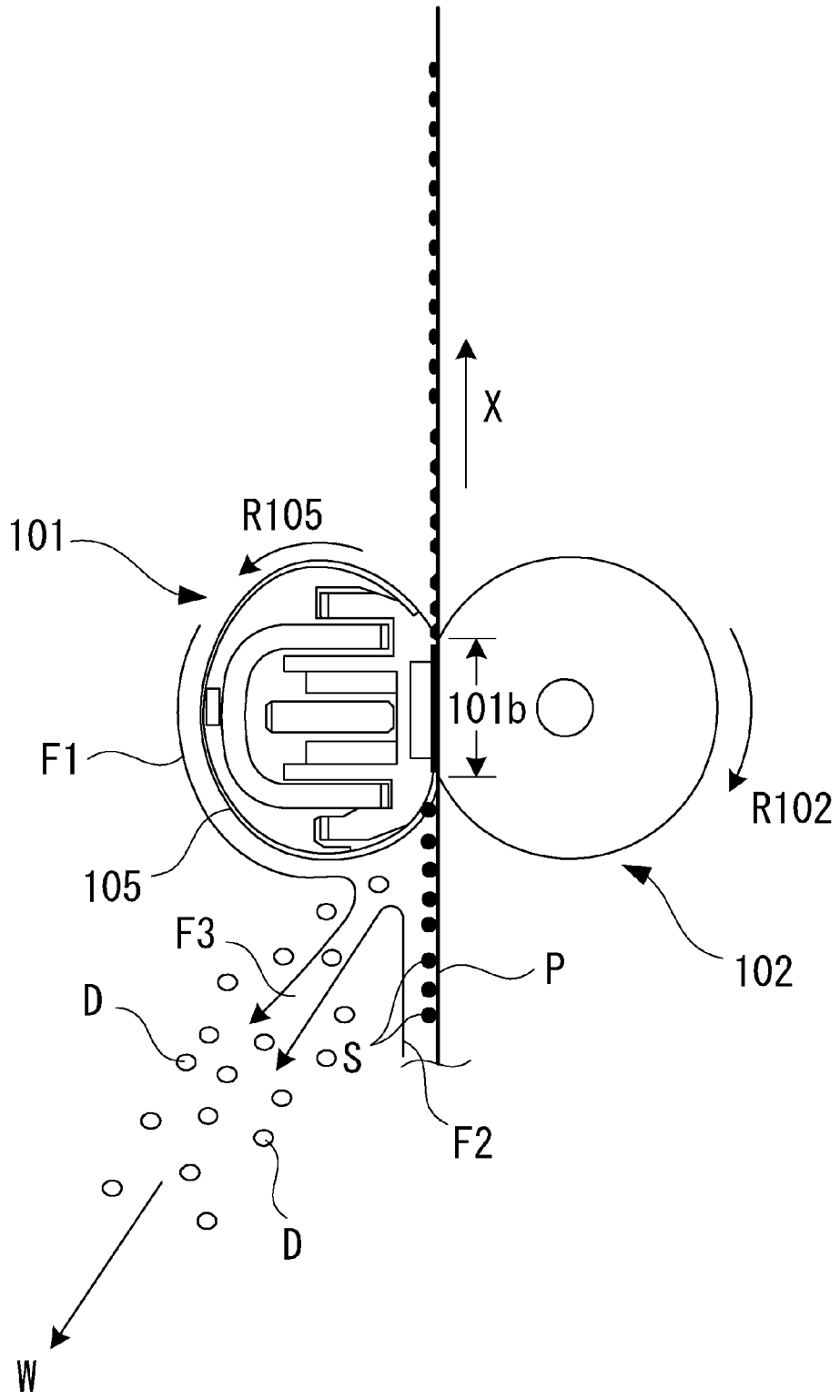
FIG. 9 is a view explaining an air flow around the fixing belt.

Next, the location of dust generation will be explained using part (a) of FIG. 8 through FIG. 9 with reference to part (b) of FIG. 3. Part (a) of FIG. 8 shows the wax adhesion area on the belt 105, which expands as the fixing process progresses. Part (b) of FIG. 8 shows the relationship between the area of wax adhesion and the area of dust generation. FIG. 9 illustrates the air flow around the belt 105.

The present inventor and others have verified that the amount of particulate dust D (UFP) generated by the wax adhering to the belt 105 is larger upstream of the fixing nip portion 101*b* than downstream of the fixing nip portion 101*b*. The mechanism is explained below.

Immediately after passing through the fixing nip portion 101*b*, the surface of the belt 105 (the parting layer 105*d*) is deprived of heat by the recording medium P, so its temperature is lowered to about 100° C. On the other hand, the temperature of the inner surface (base layer 105*a*) of the belt 105 is maintained at a high temperature by contact with the heater 101*a*. Therefore, after the belt 105 passes through the fixing nip portion 101*b*, the heat of the base layer 105*a*, which is kept at a high temperature, is transferred to the parting layer 105*d* via the primer layer 105*b* and the elastic layer 105*c*. Therefore, the temperature of the surface of the belt 105 (parting layer 105*d*) rises after passing through the fixing nip portion 101*b* in the process of belt 105 rotation, and reaches the highest temperature near the entrance side of the fixing nip portion 101*b*.

On the other hand, the wax bleeding out from the toner S on the recording medium P intervenes at the interface between the belt 105 and the toner image when the fixing process takes place. A part of the wax then adheres to the belt 105. As shown in part (a) of FIG. 8, when a part of the edge of the recording medium P passes through the fixing nip portion 101*b*, the wax transferred from the toner S to the belt 105 exists in area 135*a*. The surface temperature of the belt 105 in area 135*a* is low because the heat on the surface of the belt 105 is lost to the recording medium P in the fixing nip portion 101*b*. Since the surface temperature is low and the wax is difficult to volatilize, almost no dust D is generated in area 135*a*. As the recording medium P progresses through the fixing nip portion 101*b*, the wax is present around the entire circumference of the belt 105 (135*b*). In the area 135*c*, the surface temperature of the belt 105 is high. This is because the heat from the back of the belt 105 heated by the heater 101*a* in the nipping portion 101*b* is transferred to the surface of the belt 105 by thermal conduction. Compared to the belt 105 in area 135*a*, the belt 105 in area 135*c* has a longer elapsed time after passing through the nipping portion 101*b*. The longer the elapsed time, the higher the surface temperature becomes due to heat conduction. In this way, the surface temperature is high in area 135*c*, and the wax volatilizes easily. When the volatilized wax condenses from the area 135*c*, particulate dust D is generated. Therefore, a large amount of dust D exists in the vicinity of area 135*c*, that is, near the entrance (upstream side) of the fixing nip portion 101*b*.

The dust D near the entrance of the fixing nip portion 101*b* is diffused in the direction of the arrow W by the airflow shown in FIG. 9. That is, as shown in FIG. 9, when the belt 105 is rotating in the R105 direction, an air flow F1 along the R105 direction is generated near the surface of the belt 105. Also, when the recording medium P is fed along the X direction, an airflow F2 along the X direction of the recording medium P is generated. Furthermore, when airflow F1 and airflow F2 collide in the vicinity of the fixing nip portion 101*b*, airflow F3 is generated along the direction away from the fixing nip portion 101*b* (W direction). The filter unit 50 (see FIG. 13), which will be described later, is located in the W direction, which is the direction in which the dust D is carried by the airflow F3.

Note that the phenomenon that dust D is generated near the entrance of the fixing nip portion 101*b* and carried in the W direction in FIG. 9, i.e., the direction in which the filter unit 50 is located in FIG. 1, is a phenomenon that occurs while the recording medium P is being fed. After the control portion 500 receives the print start command signal, and before the first recording medium P is fed, the belt 105 is heated so that the fixing operation can start immediately. At this time, there is residual wax on the belt 105 that was transferred from the toner image on the recording medium P when the fixing nip portion 101*b* fixed the recording medium P during the previous print. Then, dust D is generated from the residual wax. In this case, since the heat of the belt 105 is not lost to the recording medium P, the temperature in the vicinity downstream of the fixing nip portion 101*b* in the peripheral surface of the belt 105, that is, the area 135*a* in FIG. 9, becomes high, and dust D is generated from there. This dust D is not directed in the direction where the filter 51 is located (see FIG. 1), but is sucked by the first fan 63 and discharged outside the image forming apparatus 100. The phenomenon that dust D is generated in the area 135*a* also occurs when the adjustment operation described above is performed. This is because when the adjustment operation is started, the recording medium P stops being fed and the heat of the belt 105 is not lost to the recording medium P. Wax that has been transferred from the toner image to the belt 105 immediately before the adjustment operation volatilizes in the area 135*a* and generates dust D.

<Dust Emission Volume>

Figure 10:
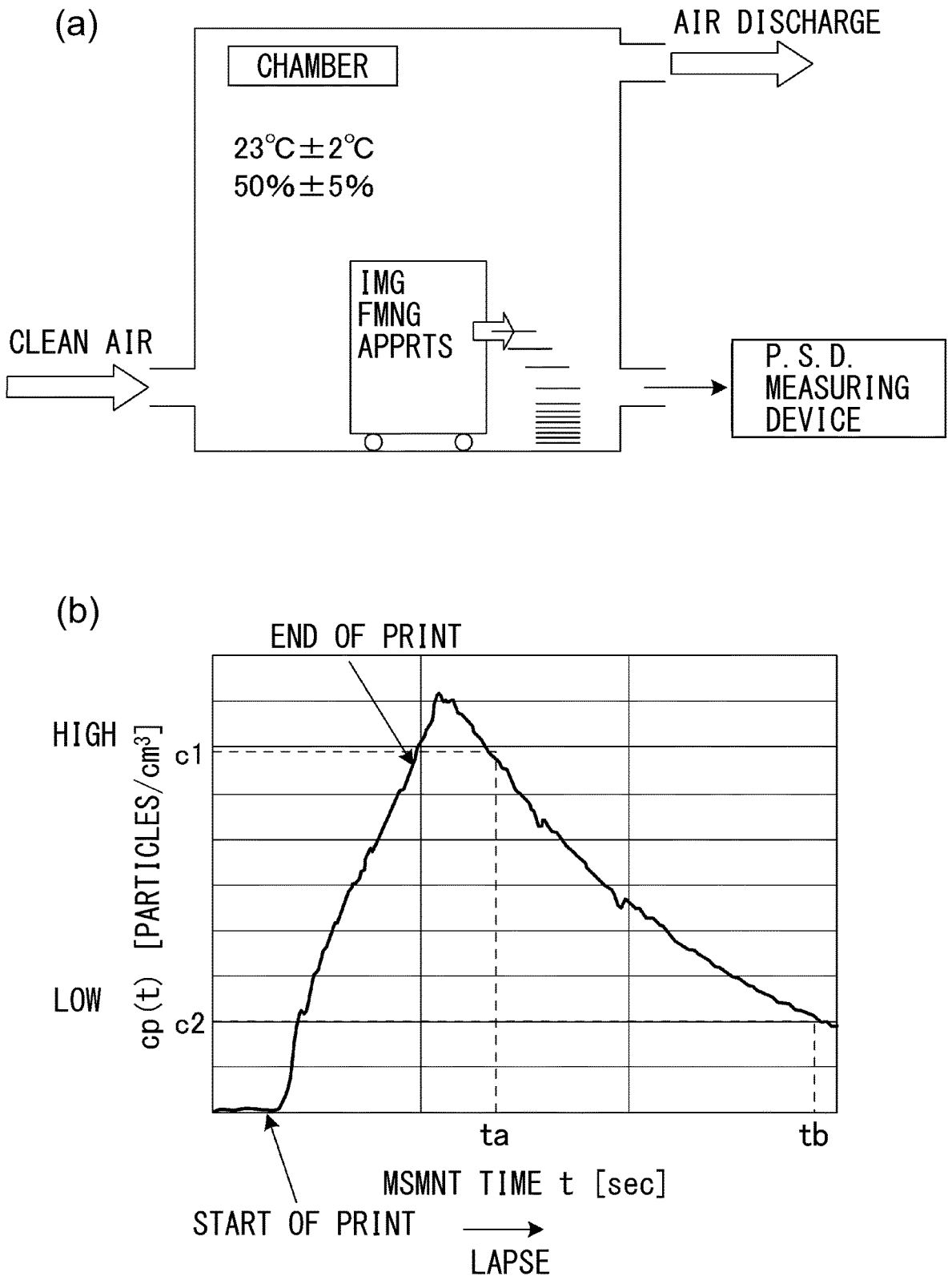
In FIG. 10, part (a) is a schematic view illustrating a measuring device of a dust emission amount, and part (b) is a graph showing a measurement results of the dust emission amount.

Next, the amount of dust emission generated by the fixing device 103 is explained using parts (a) and (b) of FIG. 10. Part (a) of FIG. 10 is a schematic diagram of the dust emission measurement device, and part (b) of FIG. 10 is a graph showing the measurement results of the dust emission. The dust emission was measured using a test apparatus (chamber volume: 6 $m^3$, ventilation rate: 2 $m^3$/h) in accordance with the German environmental label "Blue Angel Mark" and using a nanoparticle particle size analyzer (FMPS Model 3091 (manufactured by TSI)) according to "RAL-UZ205". In summary, an image forming apparatus (hereinafter referred to as the printer) is installed in the chamber, and after measuring the background for 5 minutes, image formation is performed for approximately 10 minutes, and the dust concentration in the chamber is measured for 70 minutes from the start of measurement.

The analysis follows "RAL-UZ205" as well. First, the particle loss coefficient β (1/s) due to chamber ventilation, etc. is calculated. For the particle loss coefficient β, as shown in part (b) of FIG. 10, a point in the area where particles are decreasing after printing is set as time ta, and "ta+25 minutes" is set as time tb. Assuming that the dust concentrations at this time are c1 and c2, respectively, the particle loss coefficient β can be obtained by Formula (3).

$$\beta = \frac{\ln\frac{C1}{C2}}{tb - ta} \qquad \text{Formula (3)}$$

The instantaneous emission rate (instantaneous ER: PER(t) (1/s)) is obtained according to Formula (4) as dust concentration Cp(t), measurement time t, time difference between two consecutive data points Δt, particle loss coefficient β, and chamber volume Vk.

$$PER(t) = Vk\left\{\frac{Cp(t) - Cp(t-\Delta t)\exp(-\beta\cdot\Delta t)}{\Delta t\cdot\exp(-\beta\cdot\Delta t)}\right\} \qquad \text{Formula (4)}$$

The instantaneous ER (PER(t)) described in formula (4) indicates the amount of dust emitted from the printer per unit time at time t, since disappeared particles are included in the calculation. It is possible to obtain the amount of dust emitted during printing by integrating formula (4) over entire printing time.

<Relationship Between the Instantaneous Emission Rate and the Overcooling Degree>

Figure 11A:
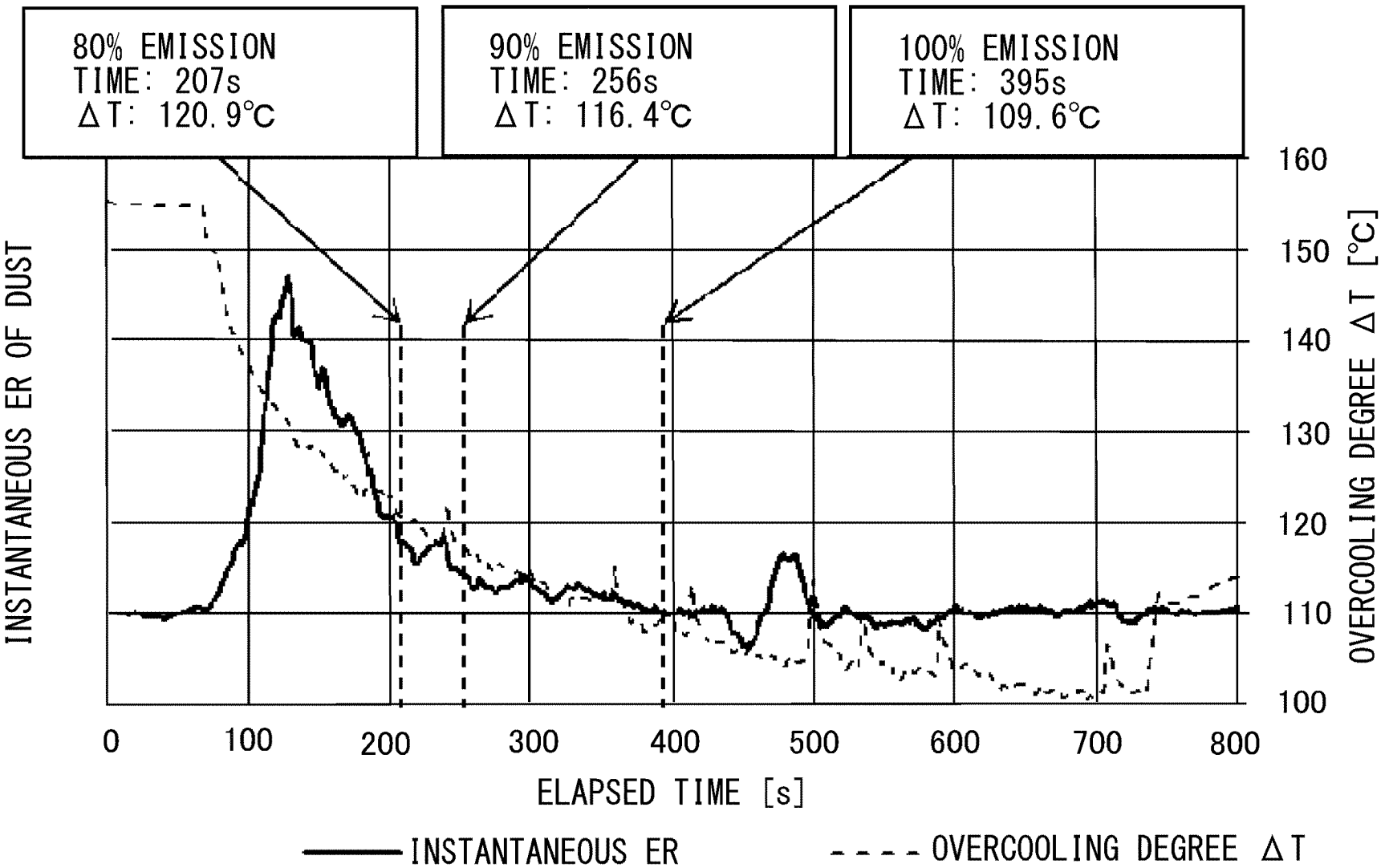
FIG. 11A is a graph showing a time transition of a instantaneous emission rate of dust and a degree of supercooling.

FIG. 11A shows an example of the time transition of the instantaneous ER and the overcooling degree ΔT when the image forming apparatus 100 has been operated continuously for about 11 minutes. The surface temperature of the belt 105 at this time is temperature B. In this case, 60 seconds before the start of printing is set to 0 seconds as the standard.

As shown in FIG. 11A, the instantaneous ER increases from the start of printing (60 seconds), gradually decreases after a peak at approximately 120 seconds, and finally becomes almost zero. The decrease of dust in spite of a fact that printing is in progress is due to the decrease in overcooling degree ΔT. As described above, the amount of dust emission is obtained by time integration of the instantaneous ER (see formula (4)). The instantaneous ER is integrated from the start of printing to obtain the elapsed time and the overcooling degree ΔT when the dust emission reaches 80%, 90%, and 100%. The result is as follows.

When the dust emission amount is 80%, the elapsed time is 207 seconds (147 seconds after the start of printing), and the overcooling degree ΔT is 120.9° C. When the dust emission amount is 90%, the elapsed time is 256 seconds (196 seconds after the start of printing) and the overcooling degree ΔT is 116.4° C. When the dust emission amount is 100%, the elapsed time is 395 seconds (335 seconds after the start of printing) and the overcooling degree ΔT is 109.6° C. In the case of temperature A, the elapsed time and the degree of overcooling degree ΔT can be obtained in the same way when the dust emission reaches 80%, 90%, and 100%.

Figure 11B:
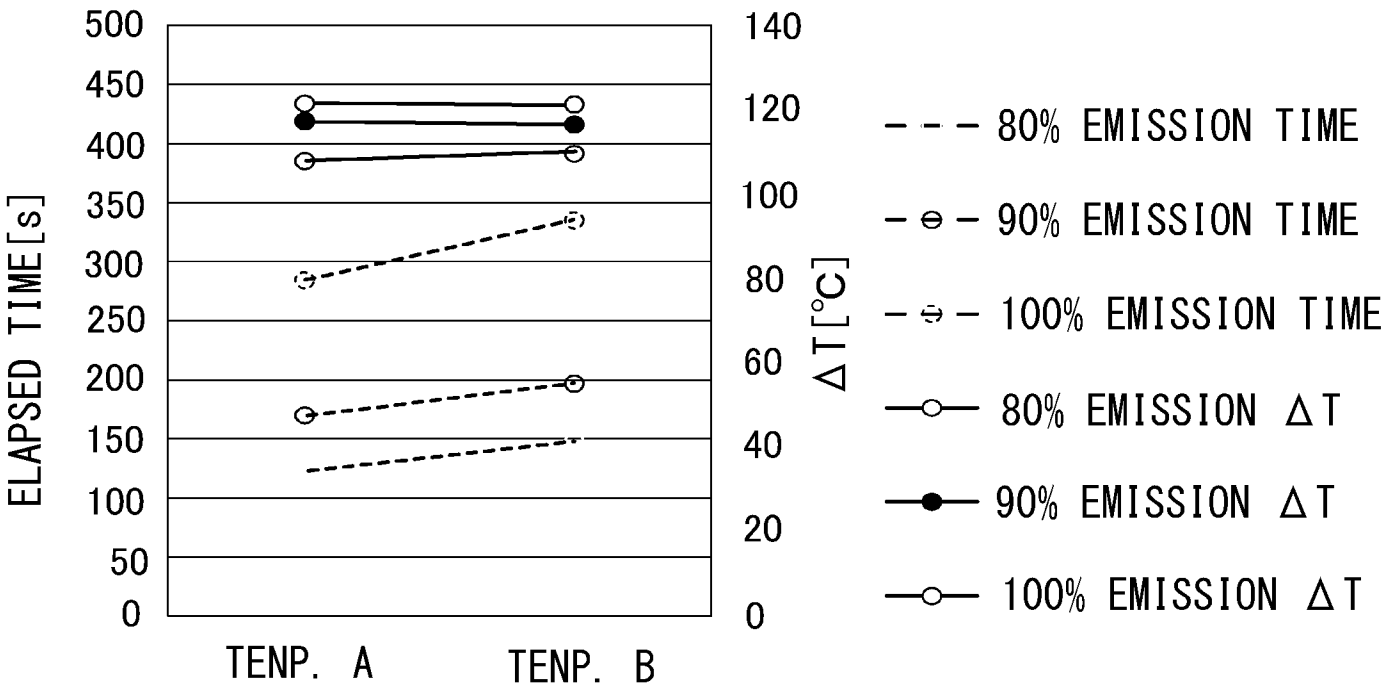
FIG. 11B is a graph explaining the relationship between the time when the dust emission ends and the degree of supercooling.

FIG. 11B shows the relationship between the elapsed time after the start of an image forming job (excluding 60 seconds before the start of printing) and the overcooling degree ΔT, which is obtained when the surface temperature Tb of the belt 105 is changed from temperature A to temperature B. It should be noted that temperature A is lower than temperature B. Comparing the elapsed time and the overcooling degree ΔT when the amount of dust emission is 80%, 90%, and 100%, while the time required for dust emission increases, the degree of overcooling degree ΔT remains almost constant, if the surface temperature Tb of the belt 105 is changed from temperature A to temperature B. That means it is possible to predict precisely the ending time point of the dust generation by measuring the overcooling degree ΔT. The s overcooling degree at the time when 80% to 100% of the dust is emitted is defined as a first temperature (ΔT_stop).

If the amount of dust emission is 80%, the first temperature is 120.9° C. If the amount of dust emission is 90%, the first temperature is 116.4° C. If the amount of dust emission is 100%, the first temperature is 109.6° C. These values are almost constant as long as the physical properties of the wax, such as a boiling point of a wax of toner and an easiness of aggregation of wax volatile substance, do not change significantly.

The physical properties of the wax should be kept within a certain range. In that case, the value of the first temperature (ΔT_stop) does not change significantly even if the configuration of the image forming apparatus or a toner is changed. Thus, if the overcooling degree ΔT is determined according to the measuring method and measuring condition as described above, it is possible to predict the ending time point of dust emission based on a value of the first temperature (ΔT_stop) even in the case that a different toner is used or the case that an image forming apparatus with a different configuration is used.

As shown in FIG. 1, in this embodiment, a filter unit 50 is provided on the upstream side of the fixing device 103 (upstream side in the feeding direction) to collect the dust as described above, which is generated by heating a toner which contains a parting agent (wax). In addition, a cooling mechanism 300 is provided adjacent to the filter unit 50 to cool the upstream side of the fixing device 103. On the other hand, on the downstream side (downstream side in the feeding direction) of the fixing device 103, an air discharge mechanism 350 is provided to discharge the air inside the main assembly 100*a* to outside in order to prevent condensation caused by the vaporization of moisture contained in the recording material P due to heating during fixing. The filter unit 50, the cooling mechanism 300, and the air discharge mechanism 350 will be described with reference to FIG. 13 through part (b) of FIG. 15.

<The Filter Unit>

Figure 13:
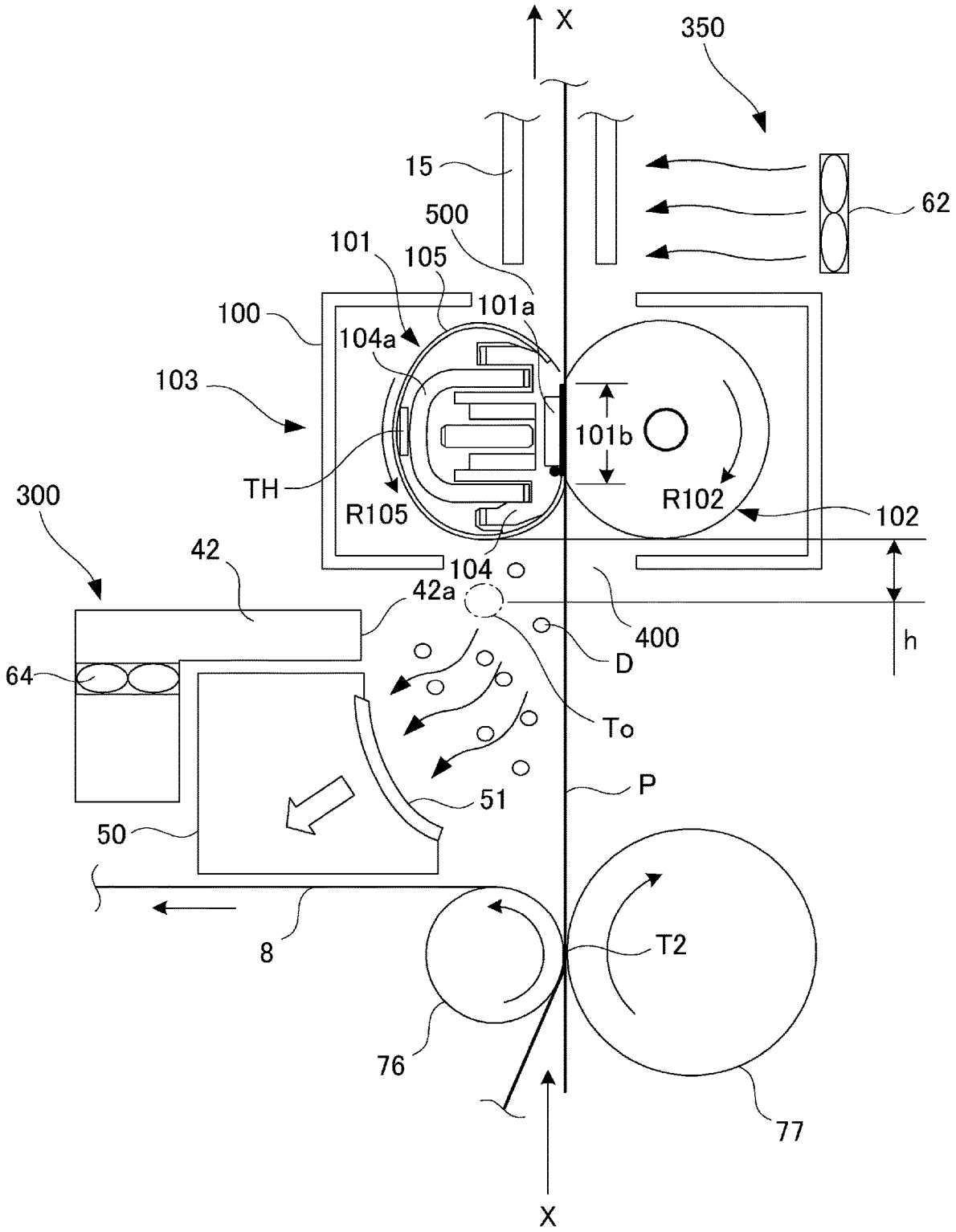
FIG. 13 is a schematic view explaining a filter unit and an exhaust mechanism.

The filter unit 50 will be described. The filter unit 50 is arranged between the belt unit 101 and the secondary transfer outer roller 77 in the feeding direction of the recording material P, as shown in FIG. 13. Alternatively, it is arranged between the fixing nip portion 101*b* of the fixing device 103 and the secondary transfer portion T2 in the feeding direction of the recording material P.

The filter unit 50 as a filtration mechanism collects dust D by sucking air containing dust D. As shown in part (a) of FIG. 14, the filter unit 50 includes a filter 51 for collecting dust D, a secondary fan 61 for sucking air, and a duct 52. The duct 52 guides air so that air near the sheet entrance 400 (see FIG. 13) of the fixing device 103 passes through the filter 51.

The secondary fan 61 is an air sucking portion for sucking air near the sheet entrance 400 to the outside of the apparatus. As shown in part (a) of FIG. 15, the secondary fan 61 includes a fan air suction port 61*a* and an air discharge port 61*b* to generate airflow from the fan air suction port 61*a* to the air discharge port 61*b*. The fan air suction port 61*a* is connected to the air discharge port 52*e* of the duct 52, and is an opening for drawing in air in the duct 52. The air discharge port 61*b* is provided toward the outside of the main assembly 100*a* (see FIG. 1), and is an opening for discharging air sucked from the fan air suction port 61*a* toward the outside of the apparatus. In this embodiment, a blower fan is used as the secondary fan 61. The blower fan has a high static pressure property and is capable of ensuring a constant air flow rate (air suction volume) even if there is an air communication resistor such as the filter 51.

The duct 52 is a guide portion for guiding air near the sheet entrance 400 toward the outside of the apparatus. The duct 52 is provided with an air suction port 52*a* near the sheet entrance 400 and an air discharge port 52*e* away from the sheet entrance 400. The air suction port 52*a* is an opening arranged between the fixing nip portion 101*b* and the secondary transfer portion T2, and is provided so as to face the fixing nip portion 101*b* side. With this configuration, the air suction port 52*a* receives dust D carried by the air flow F3 (see FIG. 9) as shown in FIG. 1. The air discharge port 52*e* is provided on the opposite side of the air suction port 52*a* among several sides of the duct 52, which is outside of the longitudinal direction of the air suction port 52*a*. As described above, the air discharge port 52*e* is connected to the fan air suction port 61*a*.

<Filter>

Figure 15:
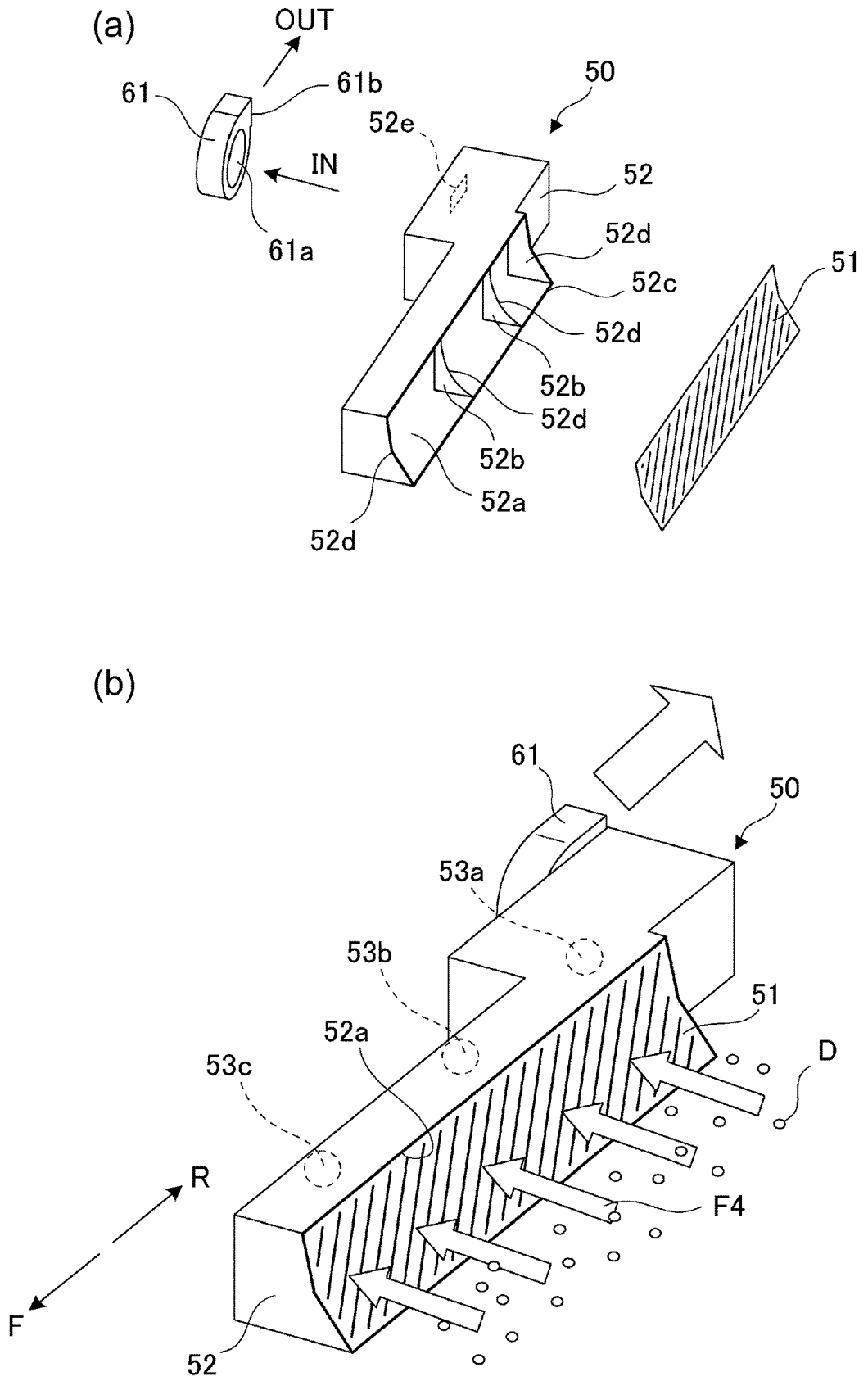
In FIG. 15, part (a) is an exploded view of the filter unit, and part (b) is a view explaining an operation of the filter unit.

As shown in part (b) of FIG. 15, it is possible to attach the filter 51 to cover the air suction port 52*a*. For further details, as shown in part (a) of FIG. 15, the duct 52 includes an edge portion 52*c* of the air suction port 52*a* and a rib 52*b* with a curved portion 52*d*. If the filter 51 is fixed to the duct 52 so that it is supported by the edge portion 52*c* and the rib 52*b*, the air suction port 52*a* is covered by the filter 51. The filter 51 in this embodiment is adhered to the edge portion 52*c* and rib 52*b* by a heat-resistant adhesive without any gaps. Thus, the air passing through the air suction port 52*a* always passes through the filter 51.

Furthermore, the filter 51 is adhered along the curved portion 52*d* of the edge portion 52*c*. Thus, the filter 51 is supported by the duct 52 while being curved. In this embodiment, the center portion of the filter 51 in the short direction is protruding toward the inside of the duct 52. That is, the center portion of the filter 51 in the short direction is curved in a direction away from the fixing nip portion 101*b*. It is preferable that the filter 51 is supported while being curved, because it increases the surface area of the filter 51 in a limited space, thereby improving the efficiency of dust collection by the filter 51.

The filter 51 as described above is a filtration member which filters (collects and removes) dust from the air passing through the air suction port 52*a*. It is desirable that the filter 51 is an electrostatic nonwoven fabric filter, in the case of collecting dust resulting from wax attached to the belt 105. An electrostatic nonwoven fabric filter is a nonwoven fabric made of fibers which hold static electricity, and it is possible to filter dust with high efficiency. However, the higher the density of the fibers, the higher the filtration performance of the electrostatic nonwoven fabric filter, but on the other hand, the pressure loss tends to increase. This relationship also applies to the case that the thickness of the electrostatic nonwoven fabric is increased. If the charge strength (strength of the static electricity) of the fibers is increased, it is possible to improve the filtration performance while keeping the pressure loss constant. It is desirable that thickness and fiber density of the electrostatic nonwoven fabric and charging strength of the fibers is set appropriately according to the filtration performance required for the filter.

Fiber density, thickness, and charging strength of the electrostatic nonwoven fabric which is used for the filter 51 in this embodiment have been set so that the air communication resistance is approximately 40 Pa and the collection rate is approximately 95% at a passing air speed of "10 cm/s". In the case of filtering toner in discharging air, the electrostatic nonwoven fabric is used with the air communication resistance of 10 Pa or less at passing air speed of 10 cm/s. Thus, in this embodiment, the filter 51, which is made of electrostatic nonwoven fabric with the relatively large air communication resistance, is used.

It is desirable that the air communication resistance of the electrostatic nonwoven fabric used for the filter 51 is greater than or equal to 30 Pa and less than or equal to 150 Pa at the passing air speed (in the case of this embodiment, greater than or equal to 5 cm/s and less than or equal to 70 cm/s) which it is expected to be used. If the air communication resistance of an electrostatic nonwoven fabric is greater than 150 Pa, it is difficult to obtain the necessary air speed with the air discharging fan which is able to be mounted in the printer 1. If the air communication resistance of an electrostatic nonwoven fabric is less than 30 Pa, it is easy to cause unevenness in the longitudinal direction with regards to the air speed of the air passing through the filter 51.

The faster the air speed of the air passing through the filter 51, the greater the amount of air per unit time which passes through the filter 51. However, the faster the air speed of the air passing through the filter 51, the easier it is to lower the temperature of the air in the vicinity of the sheet entrance 400. Thus, it is desirable that the air speed of the air passing through the filter 51 is adequate speed in the case of improving the dust collection efficiency. Specifically, it is desirable the air speed during passing through the filter 51 is greater than or equal to 5 cm/s and less than or equal to 70 cm/s. In this embodiment, the dust collection rate of the filter 51 is almost 100% at an air speed of 5 cm/s and approximately 70% at an air speed of 70 cm/s. Therefore, it is possible to collect dust with high efficiency at the air speed in this range. It is possible that the secondary fan 61 adjusts the air speed during passing through the filter 51 in the range from 5 cm/s to 70 cm/s.

The filter 51 is an elongated shape with the direction perpendicular to the feeding direction of the recording material P (along the longitudinal direction of the fixing nip portion 101*b*) as its longitudinal direction. Due to this shape, it is possible to collect the dust generated in the vicinity of the fixing nip portion 101*b* in a wide range in the longitudinal direction.

Figure 14:
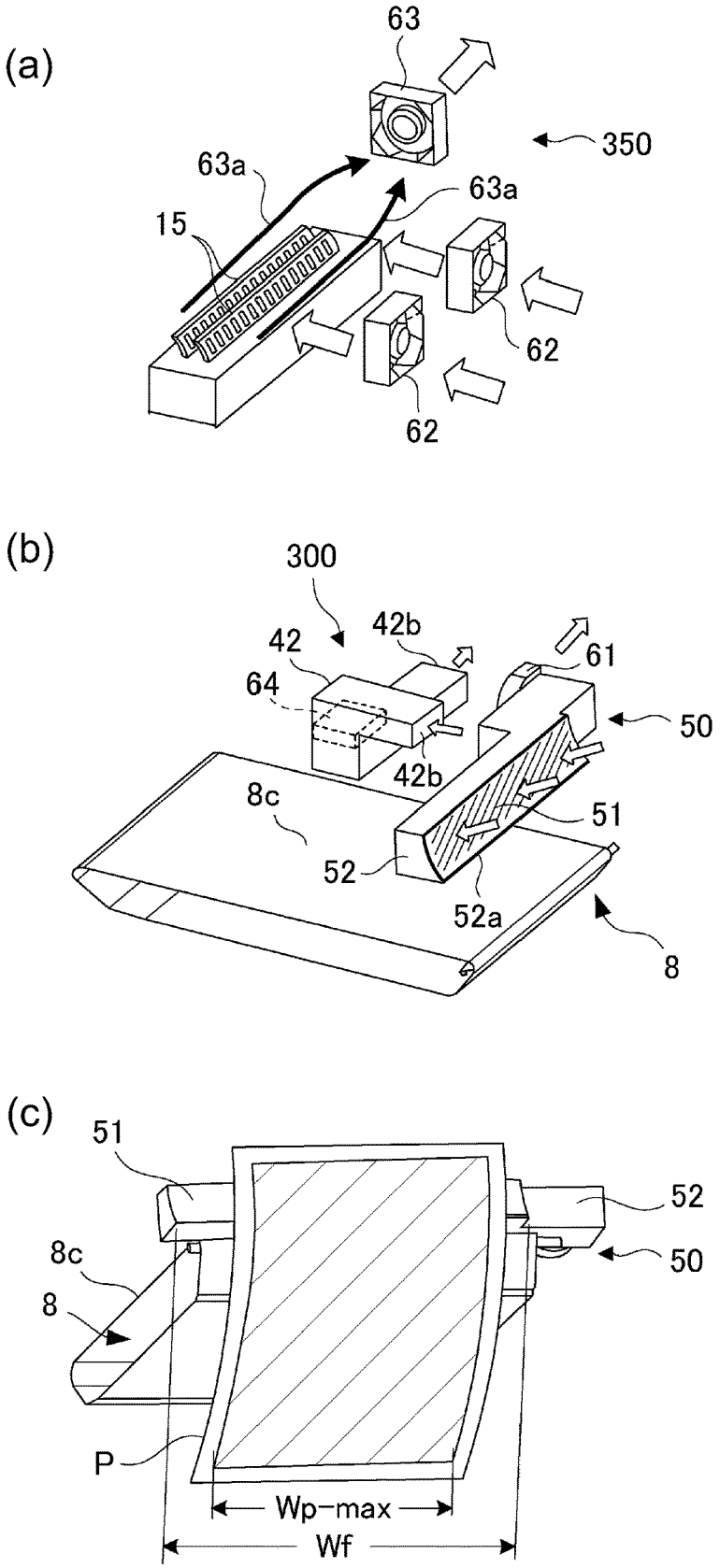

The shaded region on the recording material P in part (c) of FIG. 14 shows a region Wp-max where an image can be formed if the recording material P with a predetermined width size is used. In fact, the image is formed on the back side of the recording material P described in part (c) of FIG. 14. As shown in part (c) of FIG. 14, the width of the region Wp-max is less than the width of the recording material P. Since the toner image is formed on the recording material P in the region, wax attaches to the belt 105 in the region, and dust is generated from the wax in the region.

Since the fixing device 103 in this embodiment utilizes center(-line) basis feeding which feeds the recording material P on the basis of a center of the belt 105 with respect to the widthwise direction, it is likely to generate the dust in the region Wp-max on the minimum-width-size recording material P which is capable of being introduced into the fixing device, regardless of the width size of the recording material P. For that reason, in order to collect the dust efficiently, it is desirable that the dust is reliably collected at least in this region. Accordingly, a dimension Wf of the filter 51 may desirably be longer than the region Wp-max in the recording material P with a minimum-width size. Or, the dimension Wf of the filter 51 may desirably be longer than the recording material with the minimum-width size.

Further, the dust is capable of generating in the region Wp-max on the maximum-width-size recording material P capable of being introduced into the fixing device. For that reason, in order to reliably collect the dust, it is desirable to collect the dust in an entire region of this region. Accordingly, the dimension Wf of the filter 51 may desirably be longer than the region Wp-max in the maximum-width-size recording material P. Or, the dimension Wf of the filter 51 may desirably be longer than the maximum-width-size recording material P. In the case where the recording material P with a plurality of width sizes is available and in the case where the recording material P with a width size highest in frequency of use is known, in the region Wp-max of the recording material P thereof, it is desirable to satisfy Wf>Wp-max.

Incidentally, in this embodiment, a maximum size of the usable recording material P is an A3 size, and a minimum size of the usable recording material P is a post card size. The width of the recording material P perpendicular to the feeding direction is 297 mm for the A3 size and is 100 mm for the postcard size. Wp-max described above is a region excluding a blank region (non-image region) of 3 mm at each of end portions from the entire region of the recording material P with respect to the widthwise direction. For that reason, the width Wp max on the A3 size recording material P is 291 mm (=297−3−3), and the width Wp-max of the post card size sheet p is 94 mm (=100−3−3).

The filter 51 is disposed in the neighborhood of the belt 105 as shown in FIG. 13. Further, the filter 51 is in a positional relationship such that the filter 51 opposes the recording material P entering the fixing device 103. In the case where the collecting efficiency of the dust D is considered, the filter 51 may desirably be close to the nip 101*b* to the extent possible. However, the filter 51 and the belt 105 are caused to be excessively close to each other, there is a liability that the filter 51 is thermally deteriorated by radiation from the belt 105 and the filtering performance lowers. For that reason, the filter 51 may desirably be disposed in an appropriate distance relative to the nip 101*b*. Specifically, an interval (shortest distance) between the filter 51 and the belt 105 may desirably be 5 mm or more. On the other hand, in order to reliably collect the dust D, the filter 51 may desirably be disposed within 100 mm on the basis of the nip 101*b*.

As described above, when the filter 51 is mounted on the air suction port 52*a* of the duct 52, there is no need to employ a constitution of guiding the air toward the filter 51. For that reason, the filter unit 50 can be downsized. Further, as described above, when the filter 51 extending in the longitudinal direction is disposed in the neighborhood of the belt 105, the passing air speed of the air in the air suction port 52*a* of the duct becomes uniform with respect to the longitudinal direction. In other words, by disposing the filter 51 which is the air communication resistor on the air suction port 52*a*, an entire region of a rear surface region of the filter 51 can be maintained at a certain negative pressure. That is, the negative pressures at points 53*a*, 53*b*, 53*c* shown in part (b) of FIG. 15 are substantially same values. This is because the air communication resistance of the filter 51 is considerably larger than the air communication resistance in the duct 52. When the negative pressures at the points 53*a*, 53*b* and 53*c* are at the same level, the air speed of air F4 sucked by the filter 51 is uniformized over the entire surface of the filter 51. As a result of uniformization of the air speed, the filter unit 50 is capable of collecting efficiently (at a minimum air flow rate) the dust D generating from the belt 105.

When the air suction amount by the filter unit 50 is small, an amount of the air flowing into the neighborhood of the belt 105 also becomes small. For that reason, a lowering in temperature in the neighborhood of the belt 105 can be made small. As a result, generation of the dust can be suppressed, so that collection efficiency of the dust is also improved. Further, the temperature lowering of the belt 105 is suppressed, and therefore it is also advantageous for energy saving.

<Cooling Mechanism>

The cooling mechanism will be described as below. As shown in FIG. 13 and part (a) of FIG. 14, the cooling mechanism includes a cooling duct 42 and a fourth fan 64. The cooling duct 42 includes a cooling air suction port 42*a* with an opening and an air discharge port 42*b*, and is provided with the fourth fan 64 which is a cooling air sucking portion in the middle. The cooling air suction port 42*a* is disposed between the filter unit 50 and the fixing device 103 with respect to the feeding direction of the recording material P as shown in FIG. 13. Further, the cooling air suction port 42*a* positions in the neighborhood of a longitudinal central portion of the belt 105 as shown in part (a) of FIG. 14. In order to suck the hot air in an entire longitudinal region from the position and since the cooling duct 42 is not provided with the air communication resistor such as the filter 51, the axial fan with a high air flow rate is used for the fourth fan 64. The cooling duct 42 has a function of preventing a temperature rise of the transfer portion T2 by discharging hot air existing between the fixing device 103 and the secondary transfer portion T2.

<Discharging Mechanism>

A discharging mechanism 350 will be described as below. When the sheet P containing water content is heated by the fixing device 103, water vapor generates from the recording material P. By this water vapor, a space C on a side downstream of the fixing device 103 in the main assembly 100*a* is in a state in which humidity is high (see FIG. 1). When the humidity is high, dew condensation is liable to occur, and therefore, water droplets are liable to deposit on the guide 15. When the water droplets on the guide 15 deposit on the fed recording material P, an occurrence of an image defect is caused. For that reason, in order to prevent to increase the humidity of the space C by the water vapor generating from the recording material P, it is better to discharge the air in the space C. Therefore, in this embodiment, the discharging mechanism 350 which includes a first fan 63 and a third fan 62 is provided on a side downstream of the fixing device 103.

Next, an air flow in the main assembly 100*a* will be described. In order to collect the dust efficiently, the air flow in the main assembly 100*a*, particularly the air flow at a peripheral portion of the fixing device 103 may desirably be controlled appropriately. In the following, a constitution relating to the air flow at the peripheral portion of the fixing device 103 will be specifically described.

<Second Fan>

In the filter unit 50 described above, if the air flow rate of the second fan 61 becomes larger, the air can be sucked in a large amount, while the temperature of the air in the neighborhood of the sheet entrance 400 is liable to be lowered. The lowering in temperature of the air increases the overcooling degree ΔT and promotes the dust generation. For that reason, the air flow rate of the second fan 61 is needed to be appropriately set. The air flow rate from 20 L/min to 100 L/min is a proper range, and in this embodiment it is set at 50 L/min.

Incidentally, the filter 51 is deteriorated by sucking not only the dust but also paper powder generating from the recording material P and scattered toner scattering in a very small amount from the unfixed image on the recording material P. This is because deposition of the dust, the paper powder and the scattered toner onto the filter 51 lowers the charging strength of the electrostatic nonwoven fabric which is the material of the filter 51. For that reason, the second fan 61 may desirably be at rest in the case where the dust does not generate.

<First Fan, Third Fan>

The third fan 62 of exhaust mechanism 350 is a fan for preventing the occurrence of the dew condensation on the guide 15. The third fan 62 sucks the air from the outside of the printer 1 and blows the air against the guide 15, and thus lowers the humidity of the space C (see FIG. 1). Specifically, by the air blowing from the third fan 62, the water vapor in the neighborhood of the guide 15 diffuses to the peripheral portion of the space C, and therefore, local temperature rise in the neighborhood of the guide 15 is suppressed. Even in the case where only the third fan 62 is used, the dew condensation on the guide 15 can be suppressed. However, in such a case, designation of discharge of the water vapor is only a gap in the neighborhood of the discharging roller 78, so that the humidity in the space C gradually increases. Therefore, in this embodiment, by the first fan 63, the humidity in the neighborhood of the guide 15 is discharged to the outside of the main assembly 100*a*. In this case, by controlling the first fan 63 and the third fan 62 simultaneously, the air flow is formed inside the main assembly 100*a* to prevent the dew condensation. That is, the water vapor discharged from the space C by air blowing from the third fan 62 is not only discharged to the outside of the main assembly 100*a* toward a discharge tray 601 but also discharged to the outside of the main assembly 100*a* by the first fan 63. The air flow formed by the first fan 63 and the third fan 62 also has a function of discharging heat generated from the fixing device 103.

<Fourth Fan>

The fourth fan 64 of the cooling mechanism 300 has action of discharging air in a space between the fixing device 103 and the secondary transfer portion T2 with respect to the feeding direction of the recording material P in order to prevent temperature rise in the neighborhood of the transfer portion T2 as described in FIG. 1. When the temperatures of the transfer belt 8 and the secondary transfer outer roller 77 in the secondary transfer portion T2 excessively increase, the toner becomes soft and has the influence on the transfer process, and therefore, the fourth fan 64 discharges the peripheral air in order to cool these members. The air flow rate of the fourth fan 64 is set at about 500 L/min larger than 50 L/min of the second fan 61. However, when the fourth fan 64 lowers the temperature in the peripheral space of the belt 105, the overcooling degree ΔT described above is increased. The increase in overcooling degree ΔT leads to an increase in dust, and therefore, the fourth fan 64 should be operated only when the overcooling degree ΔT becomes sufficiently small. Incidentally, when the overcooling degree ΔT is large, it is understood from the above-described formula (1) that the temperature of the peripheral portion of the belt 105 becomes low. For that reason, even if the fourth fan 64 is stopped when the overcooling degree ΔT is large, there is no problem.

<Fan Control Process>

In this embodiment, by controlling the operation start timing of the first fan 63 and the second fan 61, the dust can be efficiently removed by the filter 51 and dew condensation of peripheral portion of the fixing device 103 can be prevented. That is, the second fan 61 is operated prior to the first fan 63 to collect the particulate dust by the filter 51 so that the particulate dust generated by the wax attached to the belt 105 is not discharged to the outside of the main assembly by the first fan 63. After that, the first fan 63 is operated and the air is exhausted. However, if the operation of the first fan 63 is started too late, it is likely to occur dew condensation in the main assembly 100*a*. Therefore, in this embodiment, the operation start timing of the first fan 63 and the second fan 61 is adjusted in order to achieve both suppressing the emission of particulate dust and preventing dew condensation. Particularly, in this embodiment, it is effective in such a case that the fixing device 103 is started up from a cold state (for example, at the time of startup associated with power-on) and an image forming job is performed.

The fan control process of the first embodiment will be described below using FIG. 16 through part (c) of FIG. 17 with reference to FIG. 1, FIG. 5, FIG. 13, and FIG. 14, etc. The fan control process shown in FIG. 16 is started upon power-on of the image forming apparatus 100 by the control portion 500 (specifically, CPU 501).

Figure 16:
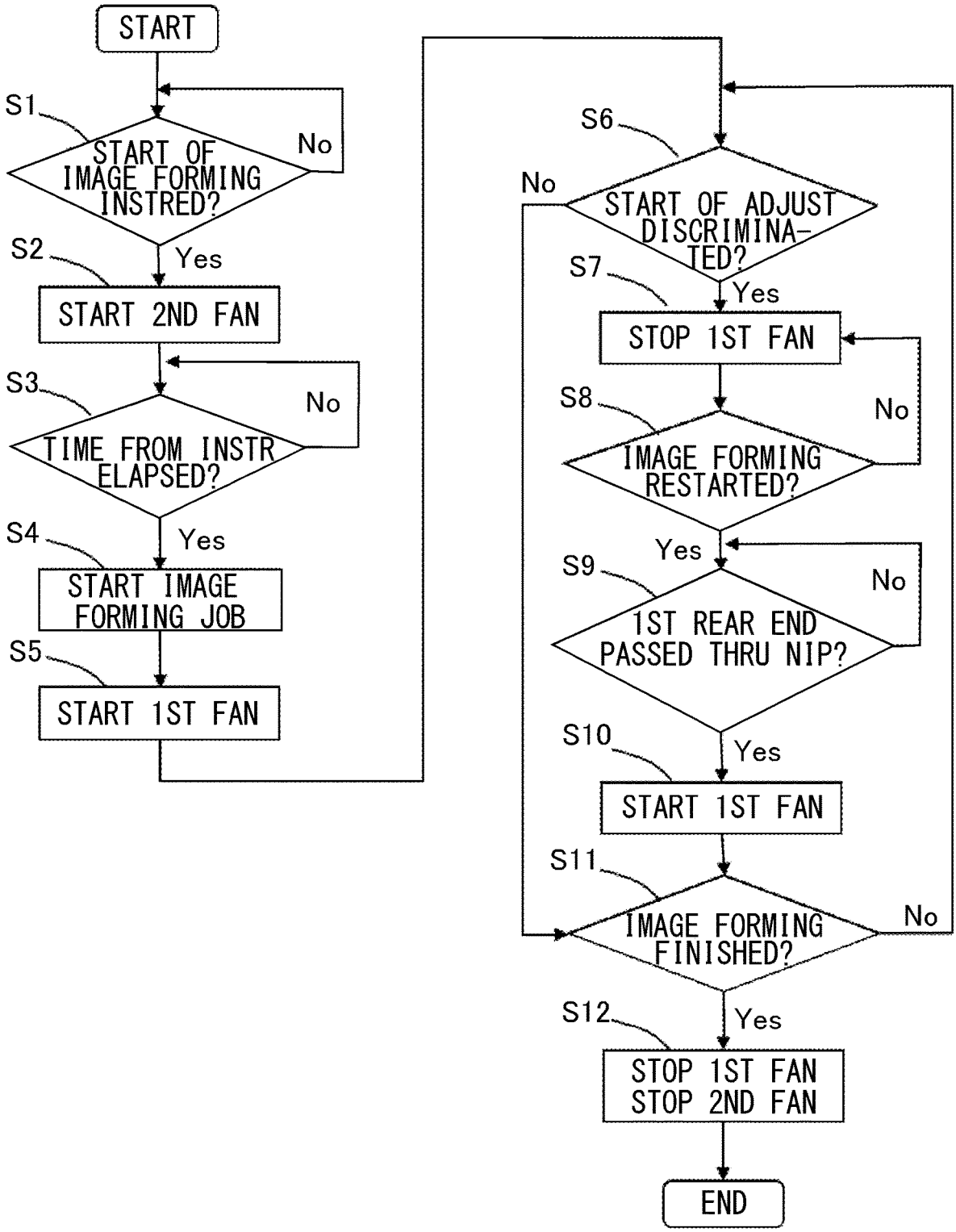
FIG. 16 is a flowchart showing a fan control process for a first embodiment.
Figure 17:
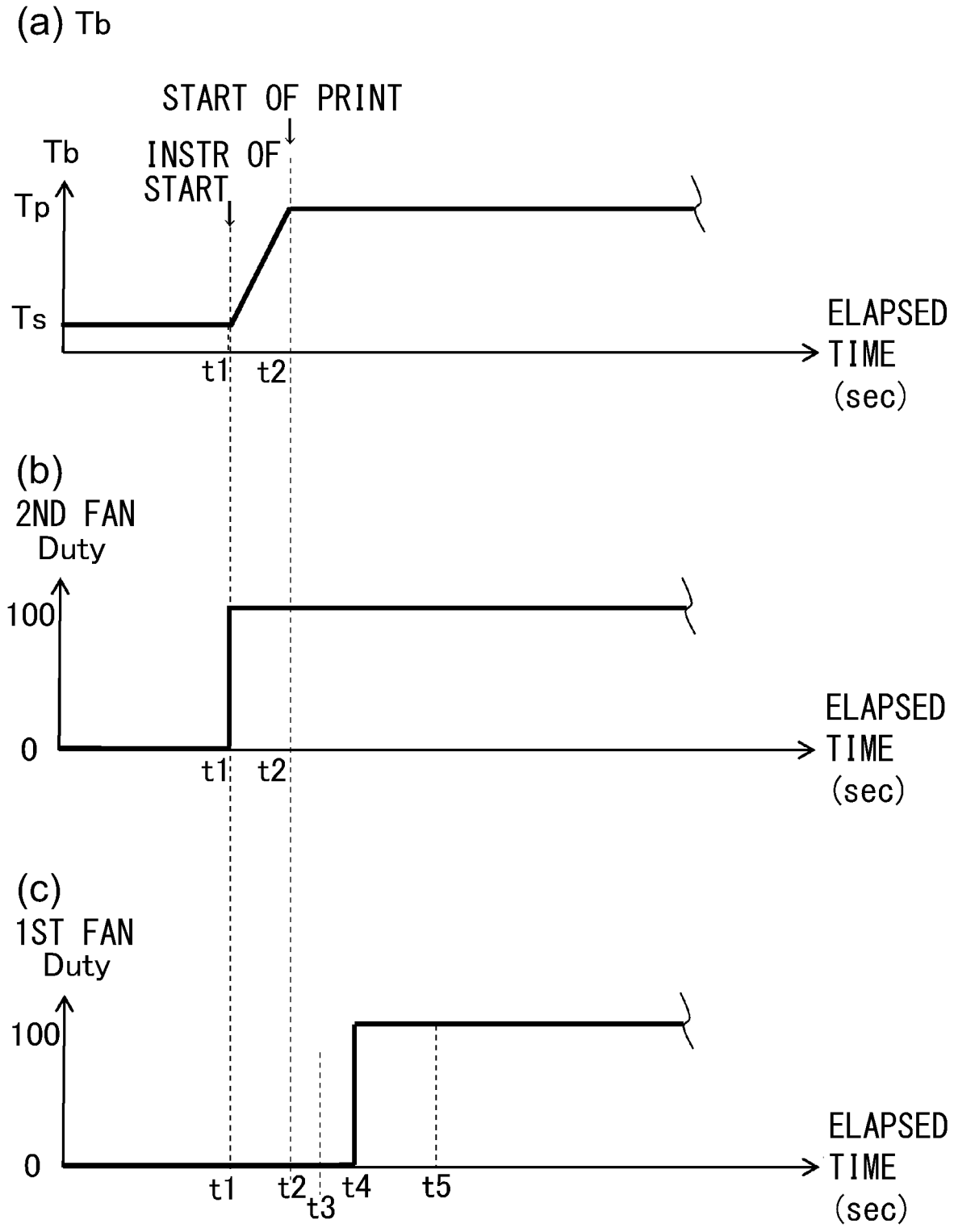
In FIG. 17 regarding the first embodiment, part (a) is a view showing the time transition of a surface temperature of the fixing belt, part (b) is a view showing an operation sequence of a second fan, and part (c) is a view showing an operation sequence of a first fan.

As shown in FIG. 16, the control portion 500 determines whether or not there is an instruction to start an image forming job from an input device 310 (S1). When there is no instruction to start an image forming job ("No" in S1), the control portion 500 waits for this fan control process to proceed. On the other hand, when there is an instruction to start an image forming job ("Yes" in S1), the control portion 500 starts the operation of the second fan 61 (S2). As described above, the dust D is generated from the residual wax on the belt 105 even before the first sheet of the recording material P reaches the fixing nip portion 101*b*. Therefore, the control portion 500 activates the second fan 61 before the temperature of the belt 105 rises, irrespective of the feeding start time of the first recording material. The time at this time is indicated by "t1" (instruction of start) (see part (a) of FIG. 17). At this time, the control portion 500 rotates the belt 105 and the pressing roller 102, and at the same time starts energizing the heater 101*a*. Then, the control portion 500 determines whether or not a predetermined waiting time (for example, 1 second) has elapsed since the start instruction of the image forming job is received from the input device 310 (S3).

When the predetermined waiting time has not elapsed since the start instruction of the image forming job is received ("No" in S3), the control portion 500 waits for the progress of this fan control process until the predetermined waiting time elapses. When the predetermined waiting time has elapsed since the start instruction of the image forming job is received ("Yes" in S3), the control portion 500 starts the image forming job (S4). In this embodiment, the image forming job is started about 10 seconds after the start instruction of the image forming job is received (time t1). The time at this time is described as the print start time (which is the time at which the signal ITOP is sent as described above) "t2" (see part (a) of FIG. 17). Then, the control portion 500 starts the operation of the first fan 63 (S5).

In this embodiment, the time at which the operation of the first fan 63 starts is, from a predetermined time before the time at which the leading end of the first sheet of recording material P reaches the fixing nip portion 101*b*, to the rear end of the first sheet of recording material P passes through the fixing nip portion 101*b*. The predetermined time before the time when the leading end of the first recording material P reaches the fixing nip portion 101*b* is described as "t3", and the time when the rear end of the first recording material P passes through the fixing nip portion 101*b* is described as "t5" (see part (a) and part (b) of FIG. 17). And the time at which the operation of the first fan 63 starts is described as "t4", which is between t3 and t5 (see part (c) of FIG. 17). Here, time "t3" is the earliest time at which the first fan 63 can be operated, and it is at the same time as or later than time "t2" (the time at which the signal ITOP is sent). The first fan 63 needs to be operated before the recording material P is finished to pass through the fixing nip portion 101*b*, but before time t2, the first recording material P has not reached the fixing nip portion 101*b*, so it is not necessary to operate the first fan 63. On the other hand, if the first fan 63 is operated earlier than time t2, the first fan 63 will continue to operate without feeding the recording material P when the adjustment operation described above is performed after the operation. In the state where the recording material P is not fed, the dust is generated in the region 135*a* described above, most of the dust is sucked by the first fan 63 and discharged to the outside of the image forming apparatus 100. Therefore, it is necessary that the time t3 is set after the time t2 when the adjustment operation is surely completed. The time at which the leading end of the first sheet of recording material P reaches the fixing nip portion 101*b* is determined by the interval from the most downstream end of the secondary transfer portion T2 to the most upstream end of the fixing nip portion 101*b* with respect to the process speed and the feeding direction of the recording material P, based on the print start time "t2". Incidentally, a recording material detection sensor (not shown) may be provided at the upstream end of the fixing nip portion 101*b*, and the time when the recording material detection sensor detects the leading end of the recording material P may be defined as the time when the leading end of the first recording material P reaches the fixing nip portion 101*b*. In this way, the time when the first fan 63 starts to operate may be configured to be the time when the image forming operation starts or the time when the feeding of the recording material starts from the recording material accommodating portion (cassette). Incidentally, "predetermined time" described above may be changed depending on the process speed during the image forming job. That is, if the process speed is fast, the "predetermined time" may be longer, and if the process speed is slow, the "predetermined time" may be shorter. That is, it is sufficient to ensure the time until an effective airflow is formed to prevent dew condensation. In this embodiment, the distance from the downstream end of the secondary transfer portion T2 to the upstream end of the fixing nip portion 101*b* with respect to the feeding direction of the recording material P is about 10 cm, and the process speed is 320 mm/s. In this case, the time it takes for the leading end of the recording material P to reach the fixing nip portion 101*b* after it passes through the secondary transfer portion T2 is about 0.3 seconds, so the "predetermined time" described above may be 0.1 seconds. In addition, it is desirable that the time t5 is as late as possible from the viewpoint of controlling dust emission, and as early as possible from the viewpoint of preventing dew condensation. In this embodiment, the time when the rear end of the first sheet of recording material P passes through the fixing nip portion 101*b* is defined as "t5". As described above, the operation time t4 of the first fan 63 may be anytime between time t3 and t5, but in this embodiment, it is set to 0.1 seconds after time t3.

Figure 12:
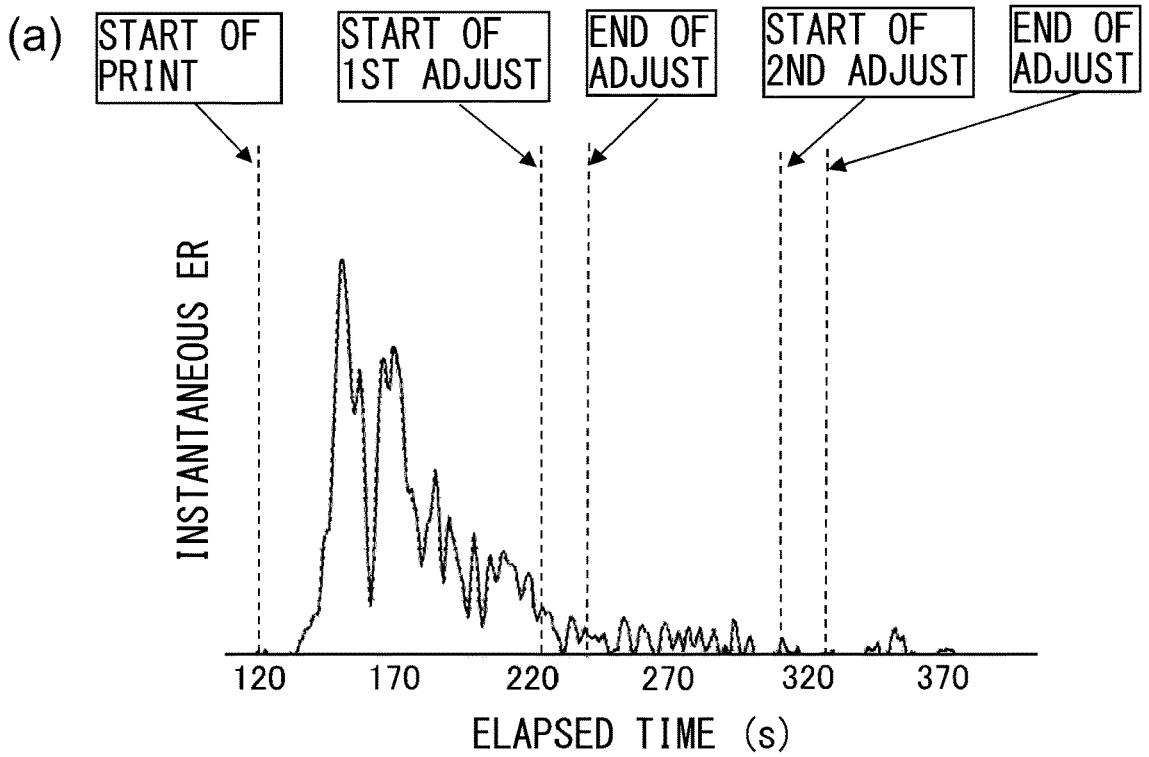
FIG. 12, parts (a) and (b), are graphs explaining a relationship between an adjustment operation and the dust emission.
Figure 12:
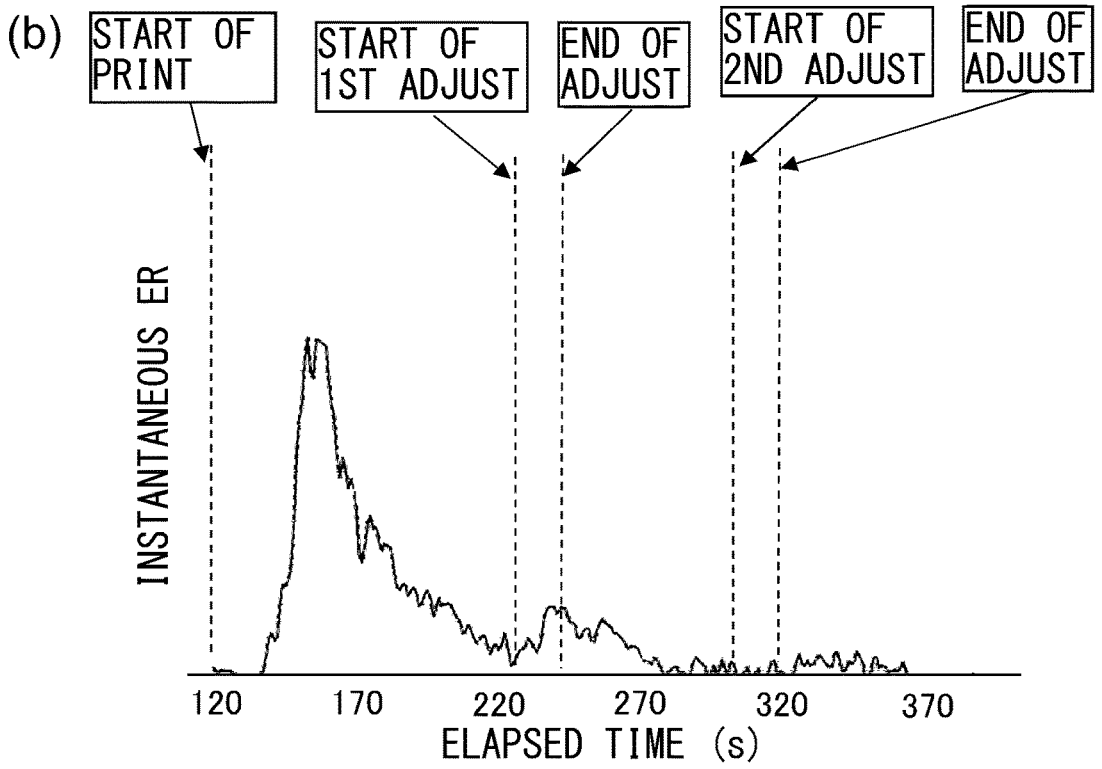

After the first fan 63 starts operating at time t4, the control portion 500 continues to judge whether to perform the adjustment operation or not (S6). If the adjustment operation is not performed ("No" in S6), the control portion 500 determines whether to terminate the image forming job or not (S11). If the image forming job is to be terminated ("Yes" in S11), the first fan 63 and the second fan 61 are stopped (S12). Next, the fan operation, in the case where the control portion 500 determines that the adjustment operation is to be performed after the start of image forming ("Yes" in S6), will be described using S7 through S10 of FIG. 16 and FIG. 18. At the time tcs ("Yes" in S6) when the control portion 500 determines that image forming is to be temporarily stopped during continuous image forming, the control portion 500 stops the first fan 63 (S7). Incidentally, at this time, the second fan 61 continues to operate for dust removal. After completing the adjustment operation, the control portion 500 send a signal ITOP and resumes image forming ("Yes" in S8). Further, at a time tr (refer to "Yes" in S9 and part (c) of FIG. 18) when the rear end of the first sheet of recording material P passes through the fixing nip portion 101*b* after resuming image forming, the control portion 500 resumes the operation of the first fan 63 (S10). The reason for stopping the first fan 63 during the adjustment operation is to prevent the dust D generated in the region 135*a* from being discharged out of the image forming apparatus 100 by the first fan 63 while the feeding of the recording material P is stopped. Part (b) of FIG. 12 shows the transition of the instantaneous ER of the dust when the first fan 63 is not stopped during the adjustment operation. In part (b) of FIG. 12, the ER is increasing at the timing when the first adjustment operation is started. Incidentally, the dust has not increased in the second adjustment operation. This is because the dust generation is eliminated as a result of the decrease in the overcooling degree ΔT described above as image forming is proceeded. Part (a) of FIG. 12 shows the ER when the first fan 63 is stopped during the adjustment operation, that is, when the control of S6 to S10 in FIG. 16 is performed. Unlike part (b) of FIG. 12, the ER does not increase in the first adjustment operation. In this embodiment, the operation is stopped at the time tcs and resumed at the time tr to prevent dew condensation, but the operation may be stopped later than tcs and resumed earlier than tr within the range between tcs and tr. If dew condensation is likely to occur due to the structure of the image forming apparatus, shortening the stopping time of the first fan 63 is effective in preventing dew condensation. Or, instead of stopping the first fan 63 completely, the fan power may be weakened by setting it to half speed, etc. Furthermore, in part (c) of FIG. 18, when the first fan 63 is operated at the time tr, it is operated at the same duty as before time tcs, but it may be operated at a higher duty or a lower duty. In addition, if the structure of the image forming apparatus is such that dew condensation does not occur easily, that is, the water vapor generated from the recording material P is easily discharged, the first fan 63 may be operated again after the time tr. For example, the first fan 63 may be operated again at the time when the rear end of the third sheet of recording material P after resumption of image forming passes through the fixing nip portion 101*b*.

As described above, in this embodiment, the operation of the second fan 61 is started before the operation the first fan 63 is started. Then, after the operation of the second fan 61 is started, the operation of the first fan 63 is started at a time between a predetermined time when the leading edge of the first recording material reaches the fixing nip portion and the time when the rear end of the first recording material passes through the fixing nip portion. In this way, by starting the operation of the second fan 61 before starting the operation of the first fan 63, since the particulate dust is collected in the filter 51, it is not likely that the particulate dust is discharged to the outside of the main assembly even if the first fan 63 is operated. In addition, since the operation of the first fan 63 is started at a timing that is neither too fast nor too slow, it is not likely to generate dew condensation inside the main assembly 100*a* even if the operation of the first fan 63 is started after the operation of the second fan 61 is started. In this way, by adjusting the operation start timing of the first fan 63 and the second fan 61, it is possible to achieve both suppression of discharging fine particulate dust and prevention of dew condensation. Furthermore, when the adjustment operation is performed after the image forming is started, by stopping the first fan 63 while the second fan 61 is operated, the effect of suppressing of discharging the dust and preventing dew condensation are enhanced.

Incidentally, the suppression effect of discharging the dust D in this embodiment is particularly effective when an adjustment operation, such as an image density adjustment operation, is performed before the image forming of the first recording material P starts. As described above, even before image forming of the first sheet of recording material P starts, if the temperature of the belt 105 rises, the dust D is generated from the residual wax on the belt 105. At this time, a part of the dust D does not move toward the direction where the filter 51 is disposed (W direction in FIG. 9) as described above, but moves toward the downstream side of the fixing nip portion 101*b*. At this time, if the first fan 63 is operating, the dust D is discharged to the outside of the image forming apparatus 100 by the first fan 63. However, according to this embodiment, the time at which the first fan 63 starts operating is determined based on the time at which the leading end of the first recording material P reaches the fixing nip portion 101*b*. That is, when the adjustment operation performs after the belt 105 reaches the target temperature Tp, the first fan 63 does not operate immediately but operates after the adjustment operation has been completed. Therefore, the dust D, which moves toward the downstream side of the fixing nip portion 101*b* during the adjustment operation, is not sucked by the first fan 63. The dust D is pulled back toward the direction of the filter 51 and removed by the suction force of the second fan 61, which has already been performed.

The Second Embodiment

Figure 21:
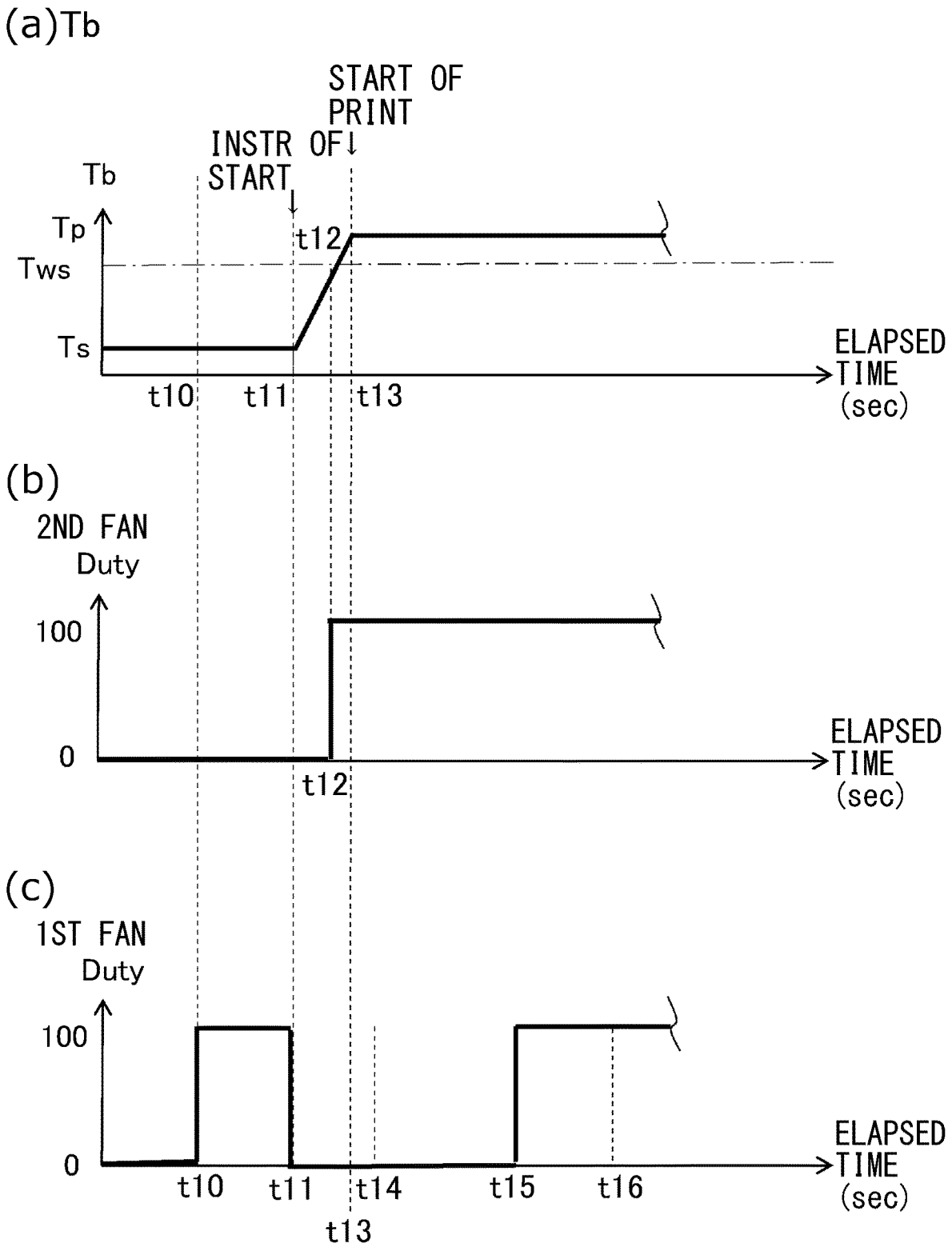
In FIG. 21 regarding the second embodiment, part (a) is a view showing a time transition of a surface temperature of the fixing belt, part (b) is a view showing an operation sequence of the second fan, and part (c) is a view showing an operation sequence of the first fan.

Next, the fan control process in the second embodiment will be described. In this embodiment, the second fan 61 is controlled depending on the overcooling degree ΔT. That is, in this embodiment, the generation of the dust is predicted by the overcooling degree ΔT, and the second fan 61 is operated if the generation of the dust is predicted. In the following, the fan control process of the second embodiment will be described by using FIG. 18 through part (c) of FIG. 21 with reference to FIG. 1, FIG. 5, FIG. 13, and FIG. 14. The fan control process shown in FIG. 18 is started upon power-on of the image forming apparatus 100 by the control portion 500 (specifically, CPU 501).

<Fan Control Process>

Figure 18:
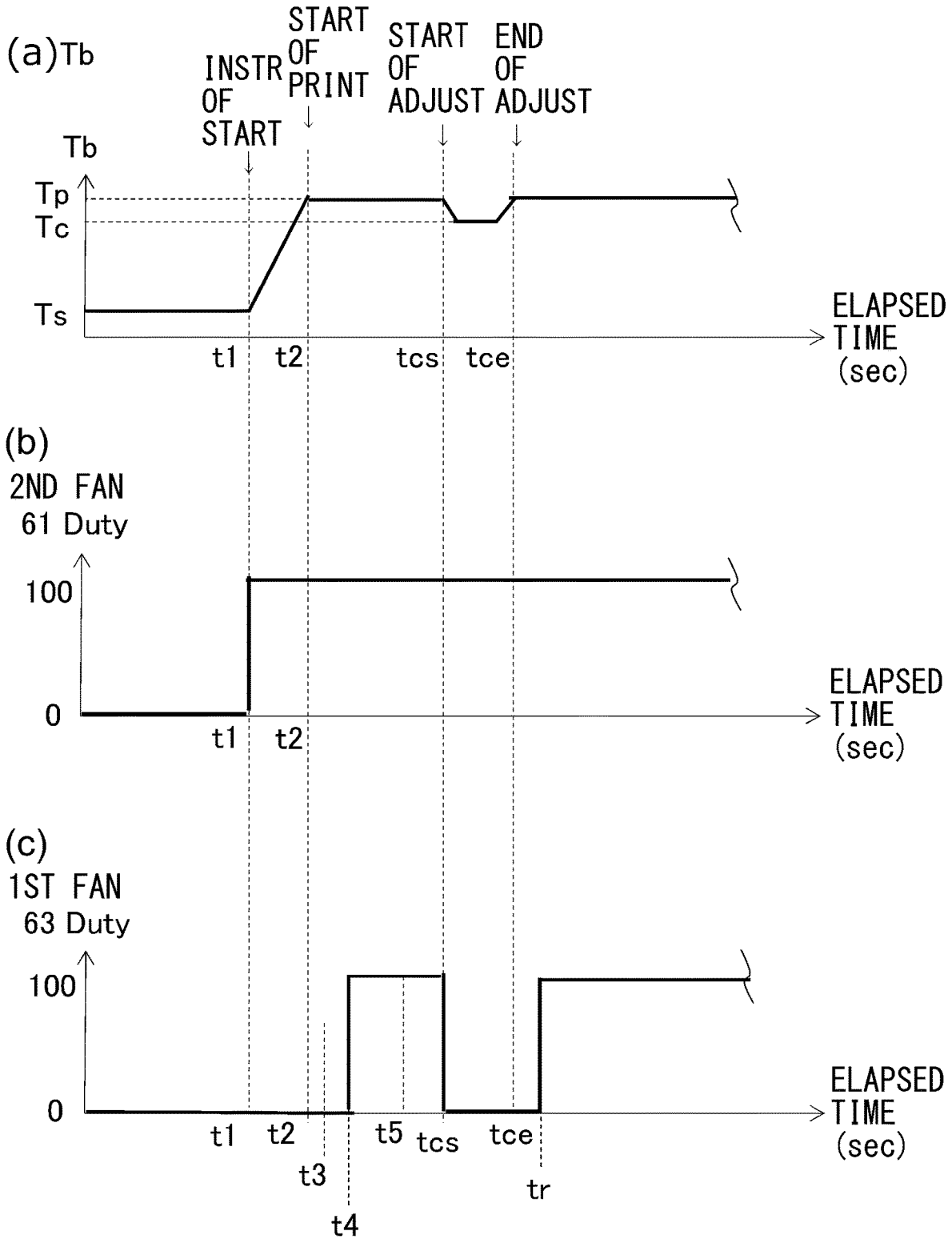
FIG. 18, parts (a), (b) and (c), are views showing a fan operation sequence when an adjustment operation is applied.

As shown in FIG. 18, the control portion 500 immediately starts the operation of the first fan 63 (S11). The time at this time is defined as "t10" (see part (c) of FIG. 21). Then, the control portion 500 discriminates whether or not there is an instruction to start an image forming job from the input device 310 (S12). If there is no instruction to start an image forming job ("No" in S12), the control portion 500 waits for this fan control process to proceed. On the other hand, if there is an instruction to start an image forming job ("Yes" in S12), the control portion 500 stops the first fan 63 (S13). The time at this point is defined as "t11" (start instruction) (see part (c) of FIG. 21). In this way, with the start of an image forming job, the first fan 63 is operated before the belt 105 is rotated and heated, and then the first fan 63 is stopped when the belt 105 is rotated and heated. Thus, by operating the first fan 63 before the start of an image forming job, the air containing water vapor remaining in the main assembly 100*a* can be discharged at the previous image forming job.

Incidentally, the operation of the first fan 63 before the start of an image forming job may be performed when the detected value (Tin) of the inside temperature sensor 65 is lower than the detected value (Tout) of the outside temperature sensor 66. That is, in such cases, the warm outside air may flow into the cold main assembly 100*a* and increase the humidity inside the main assembly 100*a*. If an image forming job is started in such a state, the water vapor generated by the heating of the recording material P may further increase the humidity in the main assembly 100*a* and occur dew condensation inside the main assembly 100*a*. To prevent this, in this embodiment, the first fan 63 is operated before the start of an image forming job and the air inside the main assembly 100*a* is warmed by the outside air, so that it is not likely to occur dew condensation during the image forming job. In addition, by stopping the first fan 63 at the same time as heating the belt 105, it is possible to accelerate to raise the peripheral temperature of the belt 105. By accelerating the temperature rise, the supercooling degree ΔT can be lowered, thus it is possible to prevent the generation of the dust caused by wax attached to the belt 105.

Next, with the start of the image forming job, the control portion 500 discriminates whether or not both of the following formulas (5) and (6) are satisfied (S14).

(Surface temperature *Tb*(° C.) of belt 105)≥(Dust generation temperature *Tws*(° C.)) formula (5)

(Dust generation temperature *Tws*(° C.))−(Spatial temperature *Ta*(° C.) of measuring point *To*)>First temperature (° C.) formula (6)

The formula (5) described above is a formula for discriminating whether or not the surface temperature Tb of the belt 105 at which the dust is capable of being generated. In part (a) of FIG. 20, when the surface temperature Tb of the belt 105 falls in a range of an arrow A, the formula (5) is satisfied. Incidentally, the dust generation temperature Tws in the formula (5) is obtained by subtracting 20° C., for example, from the dust generation temperature which is measured by the experiment. This may be in consideration of a difference between the dust generation temperature in the experiment device of part (a) of FIG. 7 and the dust generation temperature in the fixing device 103. That is, the peripheral temperature of the belt 105 lowers by sucking the peripheral air flow with rotation of the belt 105. And the overcooling degree ΔT is increased by the temperature lowering, and therefore, in this embodiment, the dust generates at a temperature 20° C. lower than the temperature in the experiment device of part (a) of FIG. 7. In the formula (5), the surface temperature Tb of the belt 105 is compared with the dust generation temperature Tws, which is obtained by subtracting 20° C. (adjusting temperature value) from the dust generation temperature which is measured by the experiment.

On the other hand, the formula (6) described above is a formula for discriminating whether or not the overcooling degree ΔT (=Tws−Ta) defined by the formula (1) satisfies an emission end condition of the particulate dust. When this formula (6) is not satisfied, discrimination that the emission of the dust is ended or there is no emission of the dust is made. In part (b) of FIG. 20, when the overcooling degree ΔT falls in a range of an arrow B, the formula (6) is satisfied. As described above, in this embodiment, the overcooling degree ΔT when the amount of the dust emission is 80% is 120.9° C., ΔT at the time of 90% is 116.4° C., and ΔT at the time of 100% is 109.5° C. In order to switch the operation of the second fan 61 when the emission of the dust is completed by 100%, the first temperature of the formula (6) may be set at 109° C. However, in many cases, when the dust is discharged by 80% or more, dust contamination of a component part such as the guiding member 15 can be sufficiently alleviated. For that reason, a first temperature of the formula (6) as a threshold temperature may only be required to be appropriately set in a range of 109° C. or more and 121° C. or less in the case where the measuring point To is in a position of 6 mm from the belt 105 toward the direction of the secondary transfer portion T2 (see "h" in FIG. 13).

In the case where the formula (5) and the formula (6) described above are satisfied, a generation condition of the dust is satisfied. When the formula (5) and the formula (6) are satisfied ("Yes" in S14), the control portion 500 starts the operation of the second fan 61 (S15). The time at this point is defined as "t12" (see part (b) of FIG. 21). In this way, the second fan 61 is operated before the start of an image forming job in this embodiment. This is because the dust generated by the residual wax on the belt 105 is removed. Incidentally, in this time, the fourth fan 64 is non-operation. This is because discharge of the dust by the operation of the fourth fan 64 without through the filter 51 is prevented. Incidentally, if at least one of the formula (5) and the formula (6) described above is not satisfied ("No" in S14), the control portion 500 starts the operation of the first fan 63 (S18) and jumps to the process of step S19.

<Measuring Point>

Here, a measuring point To in order to measure the spatial temperature Ta used for calculation of the overcooling degree ΔT (Tws−Ta) of the formula (6) will be described using FIG. 13 described above. The spatial temperature Ta is a temperature of a space in which the nucleation occurs in the peripheral portion of the belt 105.

It is difficult to accurately measure a range of the space in which the nucleation occurs, but as a result that the present inventor measured a dust density of the peripheral portion of the belt 105, the nucleation occurred within a range of 20 mm or less from the belt 105 toward the direction of the secondary transfer portion T2. Further, in the case where the position of the measuring point To is excessively close to the belt 105, the measuring point To is strongly influenced by the heat of the belt 105, so that there is a possibility that the spatial temperature To cannot properly measured. For that reason, it would be considered that there is a need to space the measuring point To from the belt 105 by at least 1 mm. Therefore, the position of the measuring point To may pass through a cross-sectional plane center of the belt 105 and a central portion of the belt 105 with respect to a widthwise direction of the belt 105, and may fall within a range of 1 mm or more and 20 mm or less from the surface of the belt 105 toward the secondary transfer portion T2 along the straight line parallel to the feeding direction of the recording material P. In this embodiment, as described above, a distance from the belt 105 to the measuring point To is 6 mm.

As a manner of acquiring the temperature of the spatial temperature Ta of the measuring point To, a method of measuring the spatial temperature Ta by a temperature detector (not shown) or a method of predicting the spatial temperature Ta from temperature information of the outside temperature sensor 66 and operation information of each fan would be considered. In this embodiment, a latter method is used, and the control portion 500 predicts the spatial temperature Ta. In the following, an example of a predicting method of the spatial temperature Ta by the control portion 500 will be described.

<Prediction of Spatial Temperature>

An inside temperature of the image forming apparatus measured by the inside temperature sensor 65 of the image forming apparatus is Tin, an outside temperature measured by the outside temperature sensor 66 of the image forming apparatus is Tout, a surface temperature of the belt 105 based on a temperature of the thermistor TH is Tb. Duty of the first fan 63 during operation is "FAN 3_duty", Duty of the second fan 61 during operation is "FAN 1_duty", Duty of the third fan 62 during operation is "FAN 2_duty", and Duty of the fourth fan 64 during operation is "FAN 4_duty". In such a case, the control portion 500 predicts the spatial temperature Ta according to the formula (7). Duty in operation is the rotation ratio (%) with the maximum number of rotations as 100%.

$$\text{The spatial temperature } Ta(\text{Prediction value}) = Tin + (A \times Tb) - (B \times T\text{out} \times \text{FAN 1_duty}) - (C \times R\text{ out} \times \text{FAN 2_duty}) - (D \times T\text{out} \times \text{FAN 3_duty}) - (E \times T\text{out} \times \text{FAN4_duty}) \quad \text{formula (7)}$$

A first term of a right(-hand) side in the above-described formula (7) means that the spatial temperature Ta is predicted on the basis of the inside temperature Tin of the image forming apparatus. A second term means that the spatial temperature Ta of the measuring point To is increased by the heat of the surface temperature Tb of the belt 105. For that reason, a sign of the second term is plus. Further, a third term to sixth term mean that the spatial temperature Ta is influenced by operation of the fans having a function of sucking the outside air (the outside temperature Tout) to the measuring point To. The outside temperature Tout is lower than the inside temperature of the image forming apparatus Tin and the surface temperature Tb, and therefore, the spatial temperature Ta shifts in a lowering direction by the operation of the fans. For that reason, signs of the third to sixth terms are minus. Incidentally, in the formula (7), "A, B, C, D and E" are constants and are determined so that a spatial temperature obtained by actually measuring the temperature at the measuring point To through an experiment and a predicted value of the special temperature by the formula (7) coincide with each other.

Incidentally, the surface temperature Tb of the belt 105 may be a value obtained by subtracting 10° C. from a detection result of the thermistor TH. This is because, in this embodiment, the surface temperature Tb of the belt 105 which has resistance of heat conduction is about 10° C. lower than a detection result of the thermistor TH. In addition, as parameters used for predicting the spatial space Ta, in addition to the above parameters, a size, a feeding speed and the number of fed sheets for the recording material P, and Duty of the fans during operation, and further an operation frequency of each of the fans may also be included.

Figure 19:
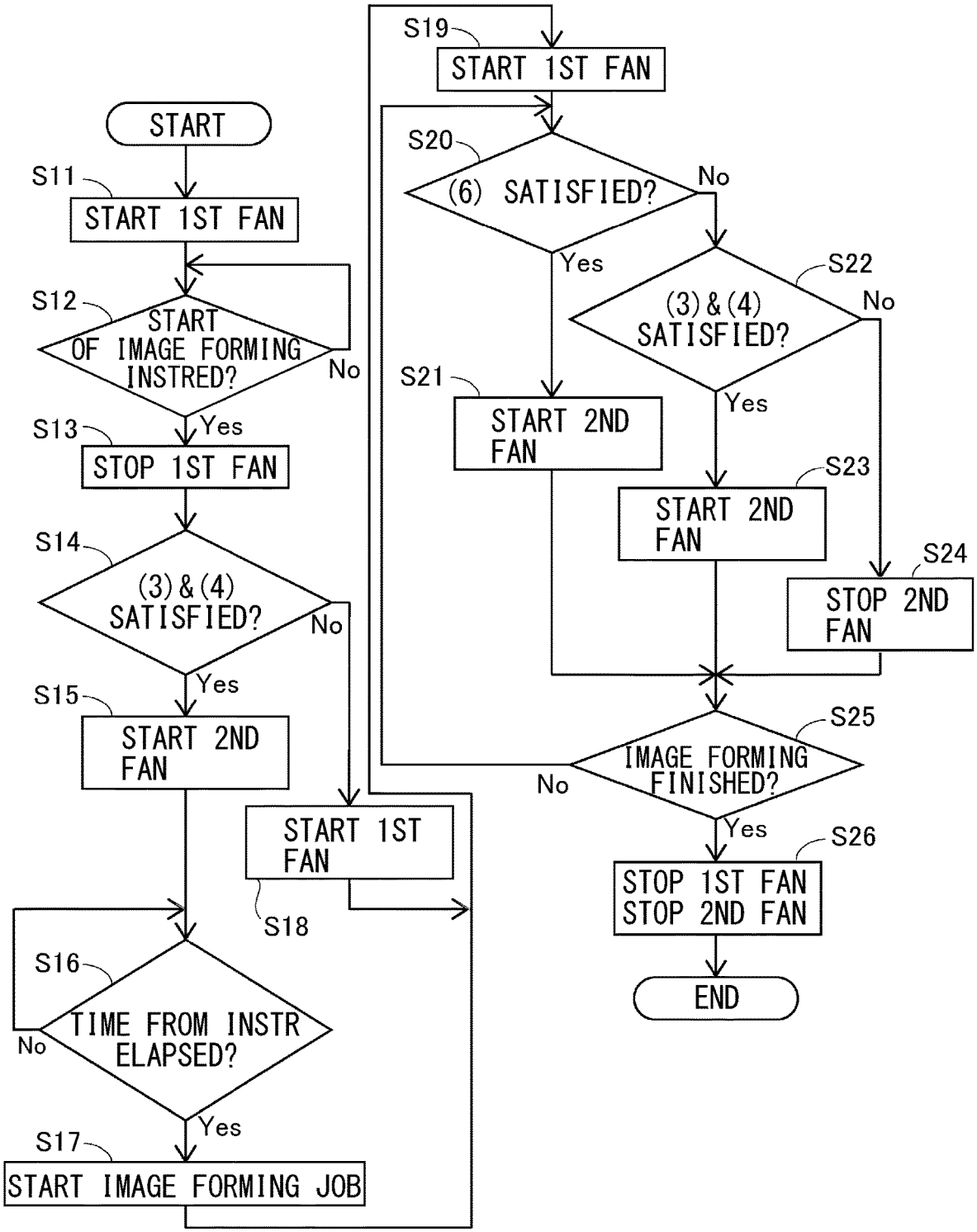
FIG. 19 is a flowchart showing a fan control process for a second embodiment.

Returning to the description of FIG. 19, the control portion 500 discriminates whether or not a predetermined waiting time has elapsed since the start instruction of the image forming job is received from the input device 310 (S16). If a predetermined waiting time has not elapsed since the start instruction of the image forming job is received ("No" in S16), the control portion 500 waits for the progress of this fan control process until the predetermined waiting time elapses. When the predetermined waiting time has elapsed since the start instruction of the image forming job is received ("Yes" in S16), the control portion 500 starts the image forming job (S17) and starts the operation of the first fan 63 (S19). The time when the image forming job starts is defined as "t13" (start of printing) (see part (a) of FIG. 21), and the time when the operation of the first fan 63 starts is defined as "t15" (see part (c) of FIG. 21).

In this embodiment, the time when the operation of the first fan 63 starts is, from the predetermined time (for example, 0.1 second) before the time when the leading end of the first sheet of the recording material P reaches the fixing nip portion 101*b*, to the time when a plurality of sheets (for example, 3 sheets) of recording materials P pass through the fixing nip portion 101*b*. The reason why the first fan 63 is operated again at time "t15" (see part (c) of FIG. 21(*c*)) is to discharge the water vapor generated when the plurality of recording materials P are heated by the fixing device 103, and to prevent dew condensation inside the main assembly 100*a*.

Then, after the image forming job is started, the control portion 500 discriminates whether or not the following formula (8) is satisfied (S20).

$$\text{Spatial temperature } Ta(\text{predicted value}) \geq \text{second temperature} \quad \text{formula (8)}$$

Figure 20:
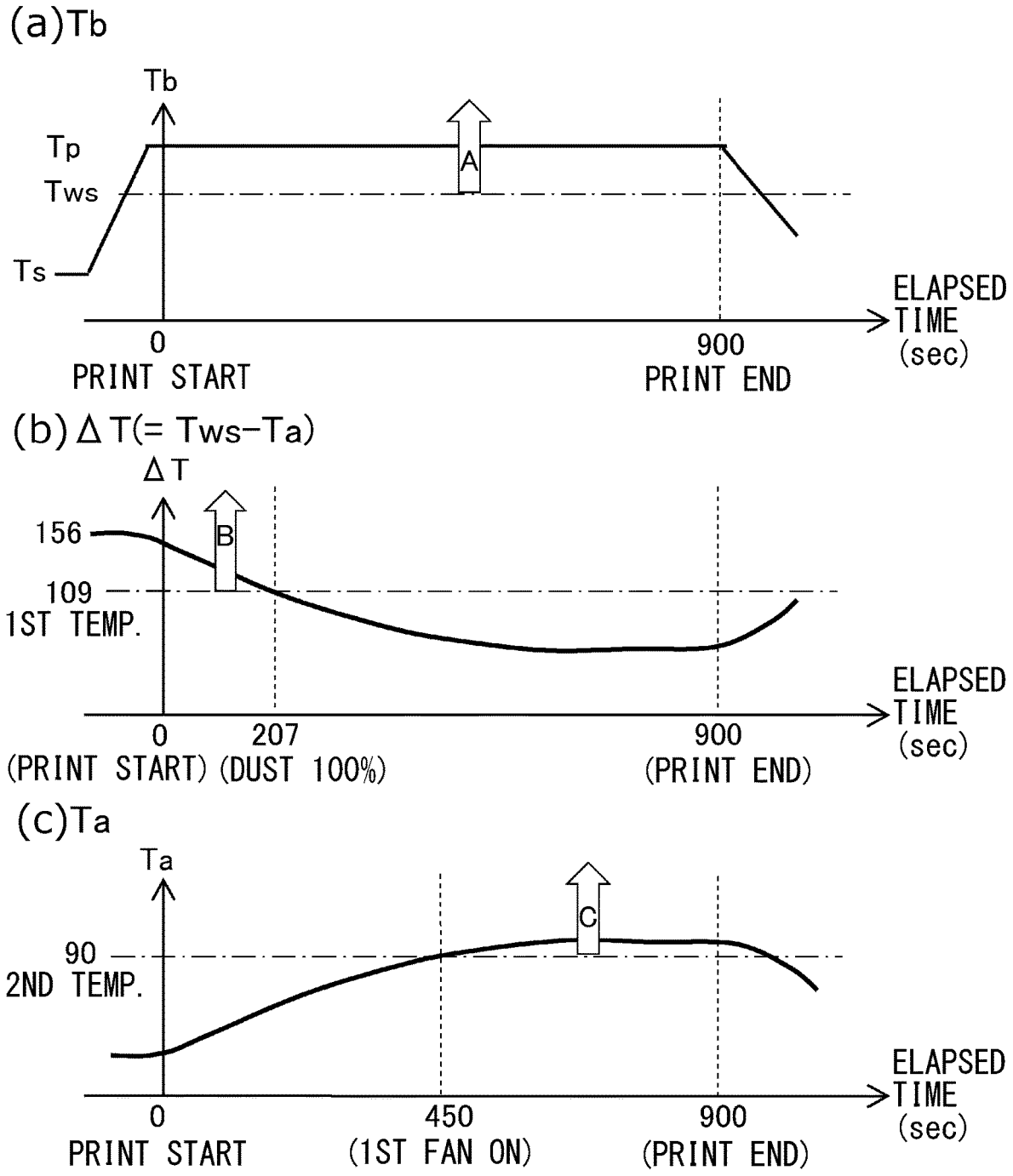
In FIG. 20, part (a) is a view showing a time transition of a surface temperature of the fixing belt, part (b) is a view showing a time transition of a degree of supercooling, and part (c) is a view showing a time transition of a space temperature.

The second temperature is set at, for example 90° C., as shown in part (c) of FIG. 20. When the spatial temperature Ta (predicted value) reaches this temperature, i.e., in the case where the spatial temperature Ta enters a region of an arrow C in part (c) of FIG. 17 and satisfies the above-described formula (8), the secondary transfer portion T2 is regarded as being increased in temperature to the extent that the temperature increase has an adverse influence on the image formation.

When the above-described formula (8) is satisfied ("Yes" in S20), the control portion 500 operates the second fan 61 (S21). Although the second fan 61 is small in air flow rate compared with the first fan 63, the second fan 61 can suck the hot air in the entire widthwise region of the belt 105, and therefore the cooling efficiency is high. By the operation of the second fan 61, deterioration of the filter 51 may advance, but in this embodiment, image quality maintenance is prioritized and the second fan 61 is operated.

In the case where the formula (8) is not satisfied ("No" in S20), the control portion 500 discriminates whether or not both the formula (5) and the formula (6) is satisfied (S22). In the case where both of the formula (5) and the formula (6) are satisfied ("Yes" in S22), the control portion 500 regards that dust is generated and operates the second fan 61 (S23). On the other hand, in the case where at least one of the formula (5) and the formula (6) are not satisfied ("No" in S22), the control portion 500 stops the second fan 61 (S24) and the air of the peripheral portion of the secondary transfer portion T2 is discharged. As described above, in the case where at least one of the formula (5) and the formula (6) is no longer satisfied during an image forming job, for example, in the case where the elapsed time of 207 seconds shown in part (b) of FIG. 20 is reached, the control portion 500 stops the second fan 61. In this way, the dust generation is predicted during an image forming job and by operating the second fan 61 and collecting the dust by the filter 51 only during the dust generation, lifetime elongation of the filter 51 can be realized. Incidentally, in the case where at least one of the formula (5) and the formula (6) is not satisfied, instead of stopping the second fan 61 as described above, the second fan 61 may be operated at a lower operating Duty (for example, 50%).

Then, the control portion 500 discriminates whether or not an image forming job should be ended (S25). In the case the image forming job is not ended ("No" in S25), the control portion 500 returns to the step S20 and repeats the above-described processes S20 to S25. On the other hand, in the case the image forming job is ended ("Yes" in S25), the control portion 500 stops the first fan 63 and the second fan 61, and ends this fan control process.

As described above, in this embodiment, the second fan 61 starts operating before the first fan 63 starts operating, and even if the first fan 63 is operated, the particulate dust is not readily discharged to the outside of the main assembly. In addition, even if the first fan 63 is started after the second fan 61 is started, dew condensation is hardly generated inside the main assembly 100*a*. Therefore, the effect of realizing both the suppression of the particulate dust emission and the prevention of dew condensation is obtained.

The Third Embodiment

Figure 22:
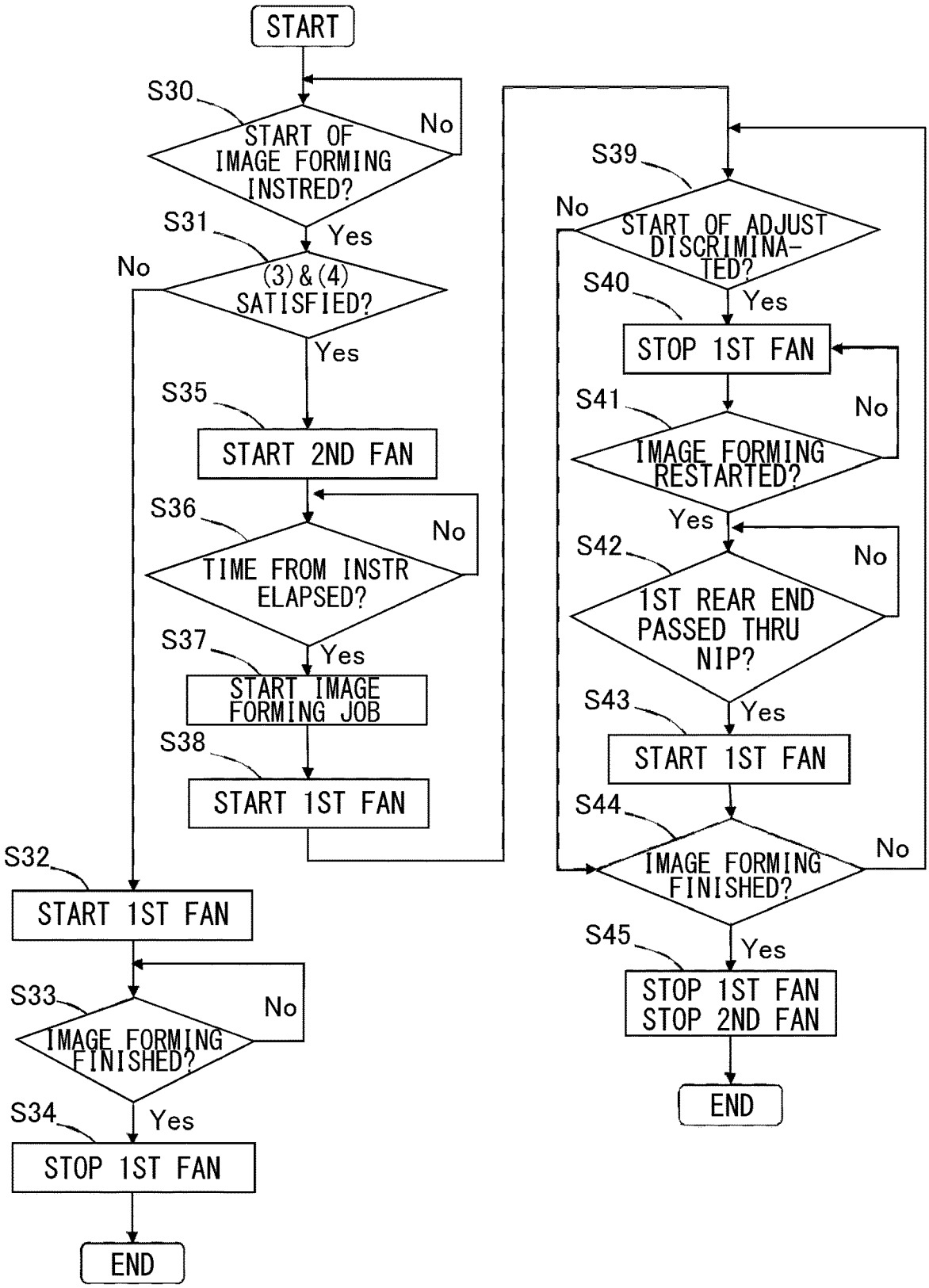
FIG. 22 is a flowchart showing a fan control process for a third embodiment.

The third embodiment will be described in accordance with the flowchart shown in FIG. 22. The difference from the first embodiment shown in FIG. 16 is that the judgement by the formula (5) and the formula (6) of the second embodiment is added between (S1) and (S2) and between (S5) and (S6) of the first embodiment. That is, (S1) in FIG. 16 and (S30) in FIG. 22 are common. (S2) to (S5) in FIG. 16 and (S35) to (S38) in FIG. 22 are common. (S6) to (S10) in FIG. 16 and (S43) to (S47) in FIG. 22 are common. In this embodiment, in (S31) and (S39), it is judged whether or not the formula (5) and the formula (6) are satisfied, and if it is satisfied, the same control as in FIG. 16 is performed. In the case the formula (5) and the formula (6) are not satisfied in (S31), the first fan 63 is operated (S32), and the first fan 63 is stopped (S34) when the image forming job is ended ("Yes" in S33). In the case the formula (5) and the formula (6) are not satisfied in (S39), the second fan 61 is stopped (S40), and the first fan 63 is stopped (S42) when the image forming job is ended ("Yes" in S41).

As mentioned in the second embodiment, in the case the formula (5) and the formula (6) are satisfied, there is no need to operate the second fan 61 because dust is hardly generated. In addition, even if the first fan 63 continues to operate regardless of adjustment operation, there is no effect on the dust. By continuing to operate the first fan 63, the effect of securely suppressing the temperature rise of the peripheral portion of the image forming portion PY to PK is obtained. By suppressing the operation of the second fan 61, it is possible to suppress the wear and tear of the filter 51.

Other Embodiments

Incidentally, in each of the above-described embodiments, a color image forming apparatus of the intermediary transfer tandem method as the image forming apparatus 100 is described as an example, but is not limited to this. Each of the above-described embodiments can also be applied to an image forming apparatus of the direct transfer method in which a toner image is directly transferred from photosensitive drums 1Y to 1K onto a recording material born and fed by a feeding belt. Further, they can also be applied to an image forming apparatuses which forms toner images of a single color (for example, monochrome machines).

INDUSTRIAL APPLICABILITY

According to the present invention, there is provided the image forming apparatus of which removes both dust and water vaper properly.

The present invention is not limited to the above-described embodiments, but can be variously changed and modified without departing from the spirit and the scope of the present invention. Accordingly, the following claims are attached for making the scope of the present invention public.

The present application claims priority on the basis of Japanese Patent Application No. 2019-028862 filed on Feb. 20, 2019, which is hereby incorporated by reference herein in its entirety.

The invention claimed is:

1. An image forming apparatus comprising:

an image forming portion for forming a toner image on a recording material by using toner containing a parting agent;

a transfer portion configured to transfer the toner image formed by said image forming portion to a sheet at a transfer nip portion;

a fixing portion configured to heat fixing the toner image transferred by said transfer portion on the sheet at a fixing nip portion;

a duct provided with a suction opening opposite to a sheet feeding passage between said transfer nip portion and said fixing nip portion;

a filter provided on said duct;

a first fan configured to discharge an air taken into said duct from said suction opening to an outside;

a second fan configured to discharge an air in a neighborhood of a sheet exit of said fixing portion;

a control portion configured to control operations of said first fan and said second fan, wherein said control portion is constructed to perform operations such that in a case in which a signal for forming the image on the sheet is inputted, an operation of said first fan is started before the fixing portion reaches a target temperature, and an operation of said second fan is started before a first sheet passes through said fixing nip portion after the operation of said first fan is started.

2. An image forming apparatus according to claim 1, wherein said fixing portion is disposed so that said fixing nip portion is positioned above said transfer nip portion.

3. An image forming apparatus according to claim 2, comprising: a sheet feeding mechanism, provided above said fixing portion, for feeding the sheet.

4. An image forming apparatus according to claim 3, wherein said fixing portion includes a pair of rotatable members configured to nip and feed the sheet at the fixing nip portion and a heating portion for heating said rotatable member, and wherein said control portion actuates said first fan in a case that both of the following formulas 1 and 2 are satisfied:

$$Tb(^\circ\,\mathrm{C.}) \geq Tws(^\circ\,\mathrm{C.}) \quad \text{(formula 1)},$$

$$Tws - Ta(^\circ\,\mathrm{C.}) > \text{predetermined temperature}(^\circ\,\mathrm{C.}) \quad \text{(formula 2)},$$

where Ta (° C.) is an ambient temperature of said fixing portion, Tb (° C.) is a surface temperature of said rotatable member, and Tws (° C.) is a vaporizing temperature of the parting agent.

5. An image forming apparatus according to claim 1, wherein said second fan starts an operation at a start of an image forming operation of the first sheet or after the start of the image formation.

6. An image forming apparatus according to claim 1, comprising a sheet accommodating portion for accommodating the sheet, wherein said second fan starts an operation at a start of the first sheet feeding from said sheet accommodating portion to said image forming portion or after the start of the feeding.

7. An image forming apparatus according to claim 1, wherein in a case in which said image forming portion interrupts an image formation temporarily during a continuous image formation, forms an image for adjusting and performs an operation of adjusting said image forming apparatus, said control portion causes said first fan to decrease output or to stop and to increase the output in accordance with a restart of the image formation.

8. An image forming apparatus according to claim 7, wherein in a case in which said image forming portion interrupts an image formation temporarily during a continuous image formation, forms an image for adjusting and performs an operation of adjusting said image forming apparatus, said control portion causes said second fan to maintain the output.

9. An image forming apparatus according to claim 8, wherein when the image forming operation is restarted, said control portion causes said first fan to increase the output until passing the first sheet through said fixing nip portion is completed after the restart.

10. An image forming apparatus according to claim 1, wherein said control portion causes said first fan to decrease output or to stop in a case that both of the following formulas are satisfied:

$$Tb(^\circ\ C.) \geq Tws(^\circ\ C.),$$

$$Tws - Ta(^\circ\ C.) > \text{predetermined temperature}(^\circ\ C.),$$

where Ta (° C.) is an ambient temperature of said fixing portion, Tb (° C.) is a surface temperature of said first rotatable member, and Tws (° C.) is a vaporizing temperature of the parting agent, and in a case that the image formation is interrupted temporarily during a continuous image formation.

11. An image forming apparatus according to claim 1, wherein said fixing portion includes a cylindrical shape film, a heater provided inside of said film and a rotatable member for forming said nip portion with said film, wherein the toner image is fixed on the sheet by heating of said heater via said film.

12. An image forming apparatus to claim 1, wherein said duct is provided on a side of said film with respect to said sheet feeding passage between said transfer nip portion and said fixing nip portion.

13. An image forming apparatus according to claim 1, wherein said second fan is disposed in a downstream side of said fixing nip portion with respect to a sheet feeding direction.

14. An image forming apparatus according to claim 1, wherein the operation of the first fan is started simultaneously with the start of the heating operation of said fixing portion or after the start of the heating operation of said fixing portion.

15. An image forming apparatus according to claim 14, wherein the operation of said first fan is started after the start of the heating operation of said fixing portion and during a period when the temperature of said fixing portion is rising.

16. An image forming apparatus according to claim 1, wherein the start of the operation of said second fan is after the start of printing.

* * * * *